US007639187B2

(12) United States Patent
Caballero et al.

(10) Patent No.: US 7,639,187 B2
(45) Date of Patent: Dec. 29, 2009

(54) BUTTON ANTENNA FOR HANDHELD DEVICES

(75) Inventors: Ruben Caballero, San Jose, CA (US); Teodor Dabov, Mountain View, CA (US); Zhijun Zhang, Santa Clara, CA (US); John Benjamin Filson, San Jose, CA (US); Emery Artemus Sanford, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 141 days.

(21) Appl. No.: 11/527,192

(22) Filed: Sep. 25, 2006

(65) Prior Publication Data

US 2008/0074329 A1 Mar. 27, 2008

(51) Int. Cl.
*H01Q 1/24* (2006.01)

(52) U.S. Cl. ..... 343/702; 343/873; 455/575.7

(58) Field of Classification Search ..... 343/702, 343/872, 873, 901, 903; 455/572.7, 343
See application file for complete search history.

(56) References Cited

U.S. PATENT DOCUMENTS

| | | | | |
|---|---|---|---|---|
| 5,440,315 | A | 8/1995 | Wright et al. | |
| 5,748,150 | A | 5/1998 | Rudisill | |
| 5,760,745 | A * | 6/1998 | Endo et al. | 343/702 |
| 6,046,699 | A | 4/2000 | Elliott et al. | |
| 6,097,733 | A | 8/2000 | Filipovic et al. | |
| 6,266,017 | B1 | 7/2001 | Aldous | |
| 6,344,825 | B1 * | 2/2002 | Wong | 343/702 |
| 6,545,642 | B1 | 4/2003 | Doub et al. | |
| 6,545,643 | B1 | 4/2003 | Sward et al. | |
| 6,859,179 | B2 | 2/2005 | Chang | |
| 6,995,716 | B2 | 2/2006 | Hwang et al. | |
| 2003/0210199 | A1 | 11/2003 | Sward et al. | |

FOREIGN PATENT DOCUMENTS

| | | |
|---|---|---|
| EP | 0 415 703 A | 3/1991 |
| EP | 0 777 296 A | 6/1997 |
| JP | 2004 253927 A | 9/2004 |
| WO | WO 99/41801 | 8/1999 |
| WO | WO 02/087011 | 10/2002 |

* cited by examiner

*Primary Examiner*—Michael C Wimer
(74) *Attorney, Agent, or Firm*—Treyz Law Group; G. Victor Treyz; Nancy Y. Ru

(57) ABSTRACT

Antennas, handheld electronic devices containing antennas, and methods for using antennas and handheld electronic devices are provided. A handheld device may have a conductive case. The antenna can be formed as part of a button such as a pushbutton. The pushbutton may protrude from the conductive case sufficiently to allow good transmission and reception of wireless signals. The protruding antenna contains a radiating element, while the conductive case serves as a ground. The radiating element may be formed from a low-profile antenna structure such as a planar antenna structure formed on a circuit board substrate. The pushbutton may be used to control operation of the handheld electronic device. With one suitable arrangement, actuation of the pushbutton antenna causes the antenna to protrude from the case and turns on transceiver circuitry in the handheld device.

29 Claims, 21 Drawing Sheets

BUTTON ANTENNA FOR HANDHELD DEVICES

BACKGROUND

This invention relates generally to antennas, and more particularly, to button-based antennas in wireless handheld electronic devices.

Handheld electronic devices such as media players are sometimes constructed with metal cases. Metal cases tend to be more durable than plastic housings and can have a superior appearance.

It may be desirable to include wireless communications capabilities in a handheld electronic device with a metal case. Wireless functionality can be used to download or upload media files, can be used to send and receive messages, and can be used to support wireless telephony.

Metal case materials such as stainless steel have a high conductivity. This poses challenges when designing an antenna. External antenna designs are often unwieldy and can add undesirable bulk and clutter to a handheld device. An internal antenna would be shielded by a high-conductivity case, so internal antenna designs are generally not considered practical in handheld electronic devices with metal cases.

It would therefore be desirable to be able to provide a satisfactory antenna for a handheld electronic device with a conductive case.

SUMMARY

In accordance with the present invention, button antennas, handheld electronic devices containing button antennas, and methods for using button antennas and handheld electronic devices are provided.

A button antenna may have a button member formed from an insulating material such as plastic. The button member may reciprocate in and out of a hole (e.g., a round hole, a slot, or any suitable aperture) in a handheld electronic device case. The case of the handheld device may be formed of a highly-conductive material such as stainless steel or other metal. The button member may have an interior portion into which a resonating antenna element is located. The case of the handheld device may be used to form a ground plane for the button antenna.

The button antenna may be placed into an undeployed position in which the resonating element is at least partially recessed within the case of the handheld device. In this position, the case of the handheld device may tend to electromagnetically shield the resonating element. The button member may have a flat top surface. When in the undeployed position, the flat top surface of the button member may lie flush with an outer surface of the handheld electronic device.

When a user desires to use the button antenna to transmit and receive wireless signals, the button antenna is placed into a deployed position. In the deployed position, the top surface of the button member and the resonating element protrude out of the handheld device past the outer surface. This allows the resonating element to transmit and receive wireless signals.

The handheld electronic device may contain radio-frequency transceiver circuitry for transmitting and receiving radio-frequency wireless signals through the button antenna. A sensor may be used to sense the position of the button antenna. When the button antenna is in the deployed position, the radio-frequency transceiver circuitry may be placed in an active state and may be used to send and receive wireless signals. When the button antenna is in the undeployed position, the radio-frequency transceiver circuitry may be placed in an inactive state to reduce power consumption.

In the undeployed position, the button is at least partially recessed within the housing of the handheld electronic device. In this type of situation, the radio-frequency transceiver may, if desired, be at least partly functional (e.g., to receive signals only, to transmit signals only, to receive signals of a certain type, etc.). Intermediate button positions are also available if desired. In an intermediate button position, the transceiver circuitry and other circuitry of the handheld device may be completely inactivated, may be partly inactivated, or may remain functional.

Further features of the invention, its nature and various advantages will be more apparent from the accompanying drawings and the following detailed description of the preferred embodiments.

DETAILED DESCRIPTION

Figure 1:
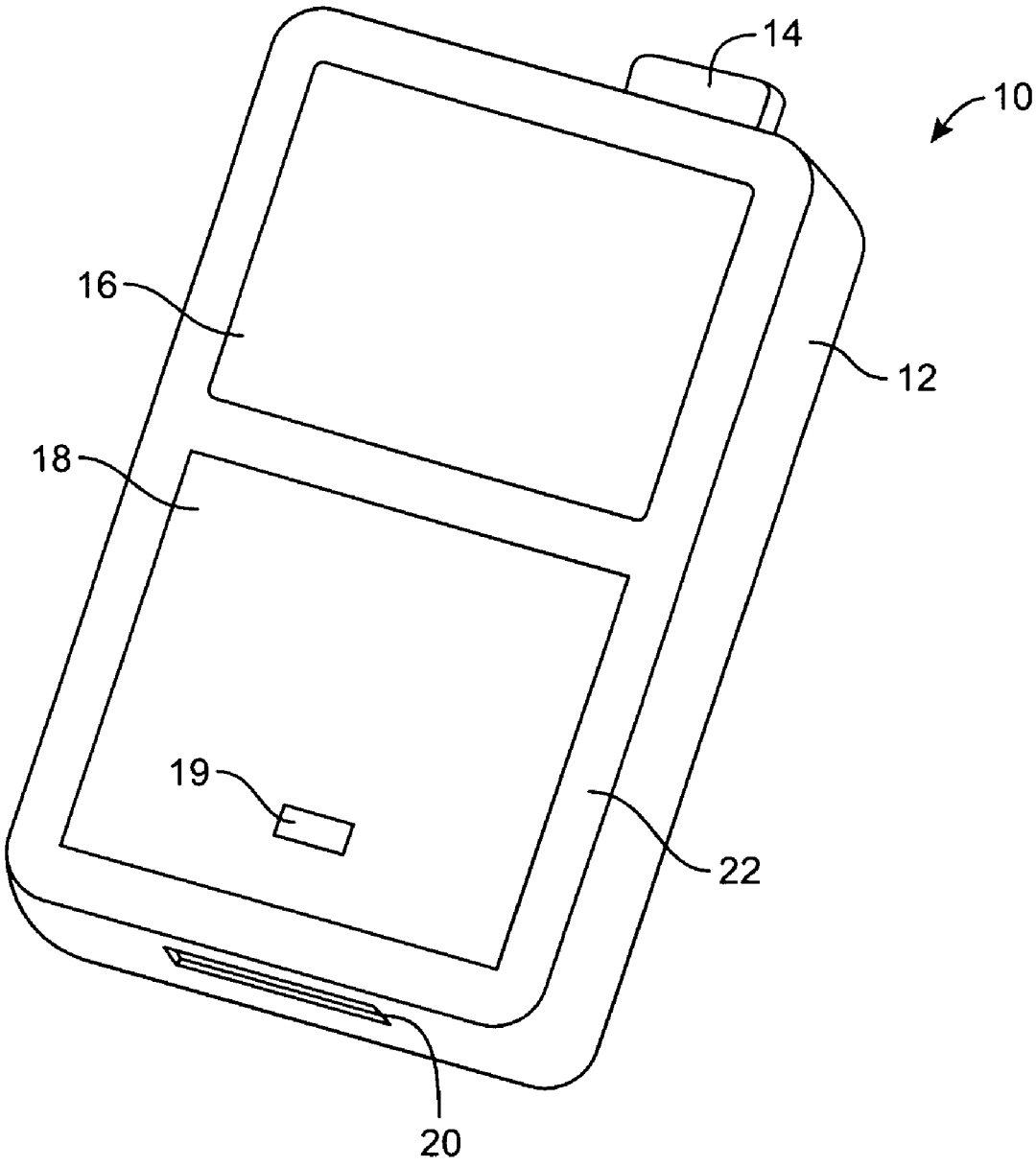
FIG. 1 is a perspective view of an illustrative handheld electronic device with a button antenna in accordance with the present invention.

Illustrative portable electronic device 10 in accordance with the present invention is shown in FIG. 1. Portable electronic devices such as device 10 may be small portable computers such as those sometimes referred to as ultraportables. Portable devices may also be somewhat smaller devices. Examples of smaller portable devices include wrist-watch devices, pendant devices, headphone and earpiece devices, and other wearable and miniature devices. With one particularly suitable arrangement, the portable electronic devices are handheld electronic devices. The use of handheld devices is generally described herein as an example, although any suitable electronic device may be used if desired.

Handheld devices may be, for example, cellular telephones, media players with wireless communications capabilities, handheld computers (also sometimes called personal digital assistants), remote controllers, and handheld gaming devices. The handheld devices of the invention may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples. Device 10 may be any suitable portable or handheld electronic device.

Device 10 includes housing 12. Housing 12, which is sometimes referred to as a case, may be formed of any suitable materials including metal, plastic, wood, glass, ceramics, other suitable materials, or a combination of these materials. In some situations, housing 12 can be formed at least partly from highly-conductive materials. The presence of conductive materials in case 12 can pose challenges for antenna designs. In particular, internal antenna designs will tend to be electromagnetically shielded by a highly-conductive case, which can make operation difficult or impossible.

Device 10 has antenna 14 that can be formed using a button structure and is therefore sometimes referred to as a button antenna. Button antenna 14 can be placed in at least two positions. In the position shown in FIG. 1, button antenna 14 is in its "out," "up," or "deployed" position. When it is desired to lower the profile of button antenna 14, the button structure is placed into a "down," "in," "retracted," "recessed," or "undeployed" position. In its undeployed position, button 14 need not protrude significantly from case 12, which allows handheld electronic device 10 to retain its attractive uncluttered appearance. Intermediate positions may also be available, depending on desired functionality.

Button antenna 14 contains a resonant element. Case 12 of handheld electronic device 10 or other suitable conductive structure may be used to form a ground plane for the antenna. To ensure that the antenna transmits and receives radio-frequency signals satisfactorily, there should generally be a sufficient spatial separation between the antenna's ground and the antenna's resonating element.

There may, if desired, be sufficient separation between the ground and resonant element for at least some operation of antenna 14 when antenna 14 is in its retracted position. Separation is not necessary between the ground and resonant element if the antenna is not to be operated. As a result, the antenna may, if desired, be retracted within housing 12 when it is not being operated so that the top surface of button 14 is flush with the surface of housing 12 or is recessed below the surface of housing 12.

To ensure high-quality wireless transmission and reception when antenna 14 is in normal operation, antenna 14 may be placed in a deployed position in which there is a significant separation between the ground plane and resonant element when antenna 14. The amount of the separation between the resonant element and the ground that is needed for satisfactory operation when the antenna is deployed depends on operating requirements for the antenna and handheld electronic device and the size and shape of the button structure in which the resonant element is housed. With one suitable arrangement, the button is nearly flush with the housing surface (e.g., the button protrudes 0-1 mm from the surface of case 12) when retracted and protrudes about 5 mm from case 12 when deployed.

Handheld electronic device 10 may have input-output devices such as a display screen 16, user input control devices 18 such as button 19, and input-output ports such as port 20. Display screen 16 may be, for example, a liquid crystal display (LCD), an organic light-emitting diode (OLED) display, a plasma display, or multiple displays that use one or more different display technologies. As shown in the example of FIG. 1, display screens such as display screen 16 can be mounted on front face 22 of handheld electronic device 10. If desired, displays such as display 16 can be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface 18. User input interface 18 may include buttons such as button 19 (e.g., alphanumeric keys, power on-off, power-on, power-off, and other specialized buttons, etc.), a touch pad, pointing stick, or other cursor control device, a touch screen (e.g., a touch screen implemented as part of screen 16), or any other suitable interface for controlling device 10. Although shown schematically as being formed on the top face 22 of handheld electronic device 10 in the example of FIG. 1, user input interface 18 may generally be formed on any suitable portion of handheld electronic device 10 (e.g., on the sides, top face, rear face, or other portion of device 10).

Handheld device 10 may have ports such as bus connector 20 that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device can be controlled using input interface 18.

Components such as display 16 and user input interface 18 may cover most of the available surface area on the front face 22 of device 10 (as shown in the example of FIG. 1) or may occupy only a small portion of the front face 22. Because these components are typically electrically shielded using conductive materials such as metal, it may not be possible to place a resonant antenna element under the front face 22 of the antenna, just as it may not be possible to mount an internal antenna within metal case 12.

If desired, the position of button antenna 14 may be used to control the functions of some or all of the components in handheld electronic device 10. Button antenna 14 may, for example, include a switch that serves as a sensor by forming an electrical short circuit when the button antenna is retracted and forming an electrical open circuit when the button antenna is deployed. The state of the electrical switch portion of button antenna 14 may be monitored by control circuitry in handheld electronic device 10 so that the functionality of the handheld electronic device can be adjusted as desired. With one suitable arrangement, for example, transceiver circuitry within the handheld electronic device 10 may be powered down when button antenna 14 is down and may be powered up when button antenna 14 is up. By selectively activating circuitry in the handheld electronic device 10, power consumption can be conserved and battery life for batteries that are used to power device 10 may be extended.

Figure 2:
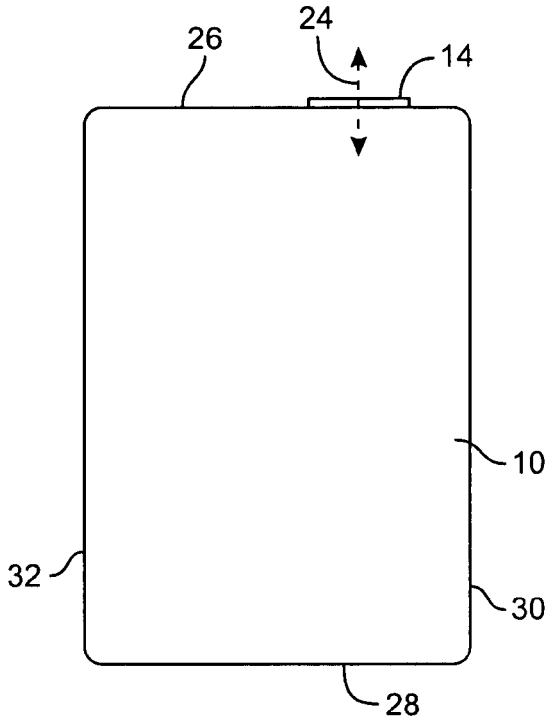
FIG. 2 is a front view of a handheld electronic device with an illustrative button antenna in its retracted or down position in accordance with the present invention.
Figure 3:
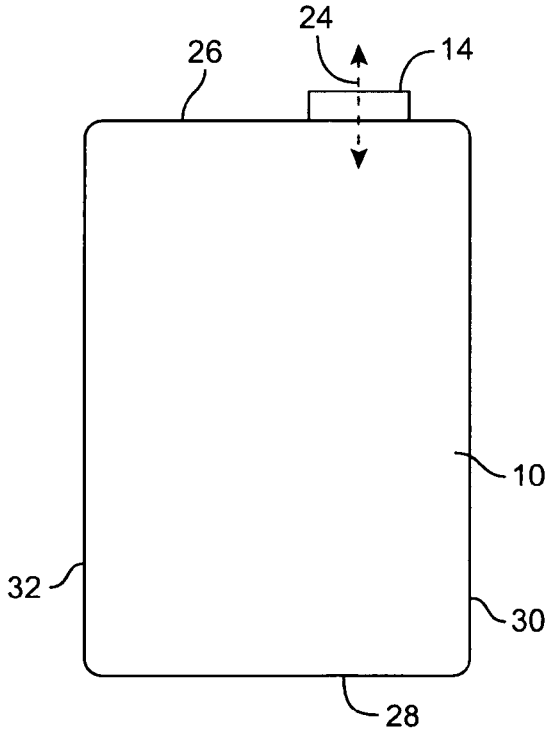
FIG. 3 is a front view of a handheld electronic device with an illustrative button antenna in its deployed or up position in accordance with the present invention.

FIG. 2 shows a front view of illustrative handheld electronic device 10 in which button antenna 14 is retracted. FIG. 3 shows a front view of illustrative handheld electronic device 10 in which button antenna 14 is deployed. Button antenna 14 may be have a linear motion, may have a rotational motion (e.g., as with a rocker switch), or may exhibit any other suitable type of motion when transitioning between its deployed and undeployed states. In the example of FIGS. 2 and 3, button 14 travels along axis 24 and extends from upper side surface 26 of case 12. If desired, button 14 may extend out of other portions of case 12, such as lower side 28, right side 30, left side 32, the case's back side (not shown), or any corner between these sides.

Figure 4:
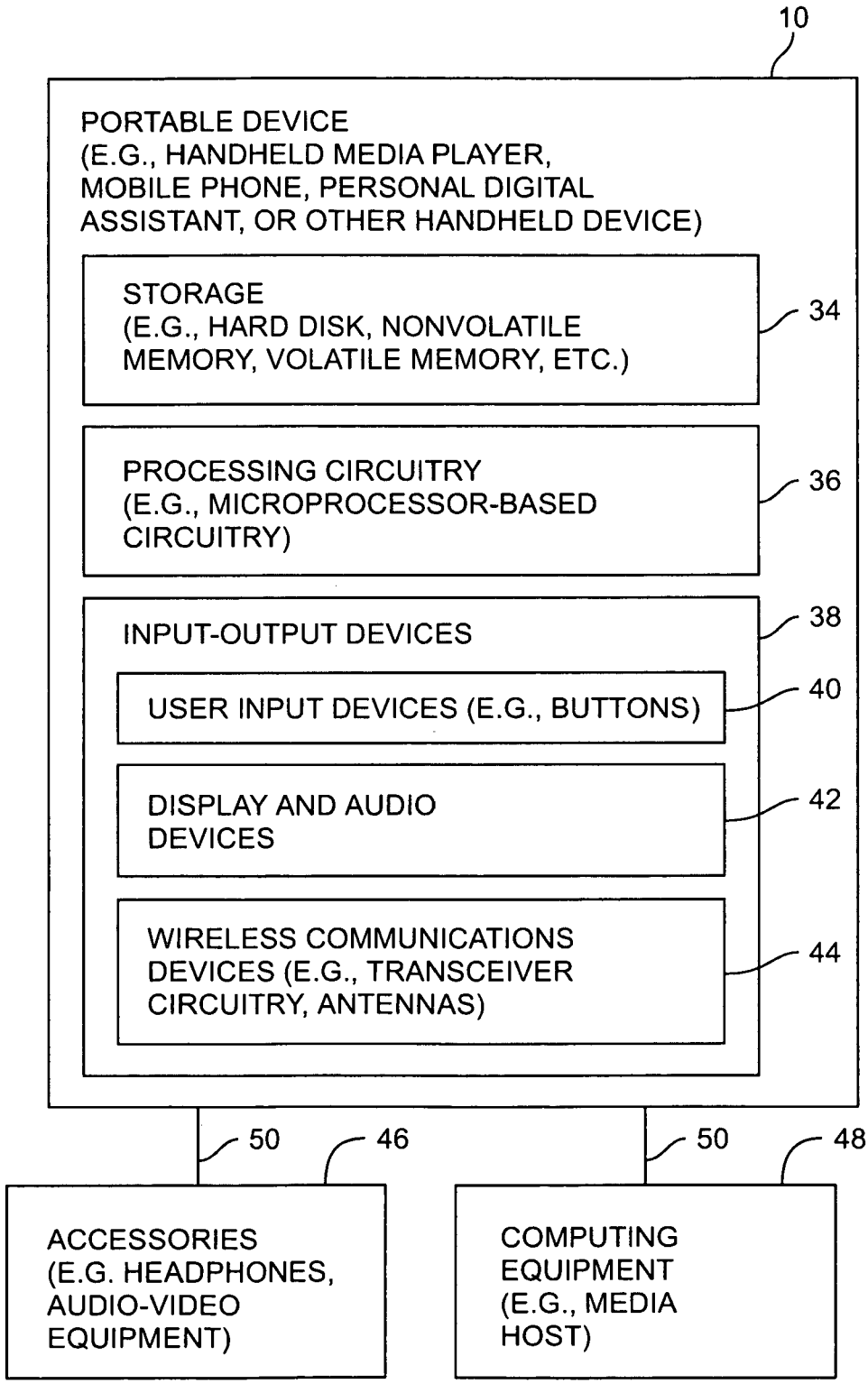
FIG. 4 is a schematic diagram of an illustrative handheld electronic device and illustrative equipment with which the handheld electronic device may interact wirelessly in accordance with the present invention.

A schematic diagram of illustrative handheld electronic device 10 that may contain button antenna 14 is shown in FIG. 4. Handheld device 10 may be a mobile telephone, a mobile telephone with media player capabilities, a handheld computer, a remote control, a game player, a combination of such devices, or any other suitable portable electronic device.

As shown in FIG. 4, handheld device 10 may include storage 34. Storage 34 may include one or more different types of storage such as hard disk drive storage, nonvolatile memory (e.g., FLASH or electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits.

Input-output devices 38 may be used to allow data to be supplied to device 10 and to allow data to be provided from device 10 to external devices. Display screen 16 and user input interface 18 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas such as button antenna 14 of FIG. 1, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content). Computing equipment 48 may be a server from which songs, videos, or other media are downloaded over a cellular telephone link or other wireless link. Computing equipment 48 may also be a local host (e.g., a user's own personal computer), from which the user obtains a wireless download of music or other media files.

Antenna 14 and other wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz, and the Bluetooth® band at 2.4 GHz. These are merely illustrative communications bands over which antenna 14 may operate. Antenna 14 may be configured to operate over any suitable band or bands. If desired, multiple antennas 14 may be provided to cover more bands or one or more antennas 14 may be provided with wide-bandwidth resonating elements to cover multiple communications bands of interest. A tunable design may be used for antenna 14 when it is desired to cover a relatively larger range of frequencies without broadening the bandwidth of the antenna when operating at a fixed frequency. Multiple button antennas may be provided on a single device, such as when multiple bands are desirable.

Figure 5:
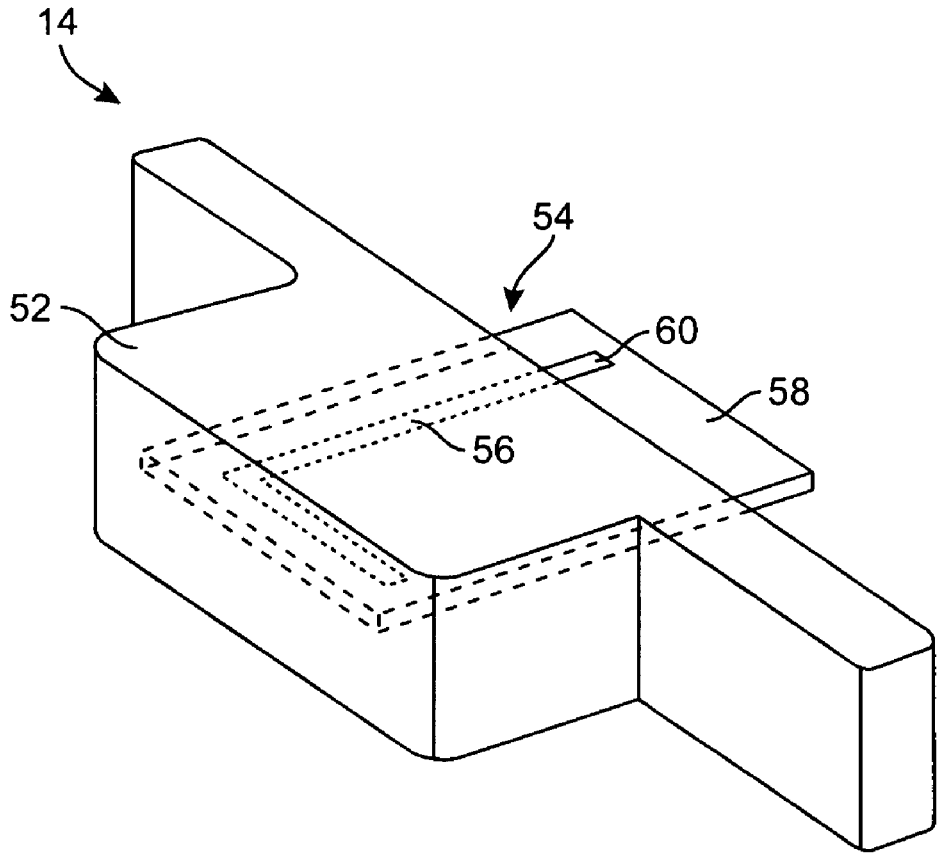
FIG. 5 is a perspective view of an illustrative button antenna in accordance with the present invention.

A portion of illustrative button antenna 14 is shown in FIG. 5. As shown in FIG. 5, button antenna 14 may be formed from a button member 52. Button member 52 may be formed from plastics such as polycarbonate-based plastics or plastics based on acrylonitrile-butadiene-styrene (ABS) copolymers. During fabrication, resonating element 54 is placed in the interior portion of button member 52 (e.g., in a slot or other suitable hollow recess formed in button member 52).

In the example of FIG. 5, resonating element 54 can be formed from an L-shaped strip of conductor 56 that has been fabricated on the surface of a substrate 58. The conductor 56 that is used in antenna 14 may be any suitable highly-conductive material, such as copper, gold, alloys containing copper and other metals, high-conductivity non-metallic conductors (e.g., high-conductivity organic-based materials, high-conductivity superconductors, highly-conductive liquids), etc. Substrate 58 may be any suitable support structure, such as printed circuit board material, flexible printed circuit board materials ("flex circuits"), polytetrafluoroethylene, polyimide, epoxy, plastic, etc. Electrical contact may be made to the conductor 56 in a contact region such as contact region 60. Resonant element conductor 56 may be formed using any suitable technique (e.g., printing of conductive traces on a substrate, etching of deposited films using photolithography, laser or mechanical trimming, etc.).

In the example of FIG. 5, resonating element 54 is depicted as having a thin planar profile, which may facilitate placement of radiating element 54 within a low-profile button member 52. The use of a radiating element with a planar structure is, however, merely illustrative. Radiating element 12 may be formed in any suitable shape.

Figure 6:
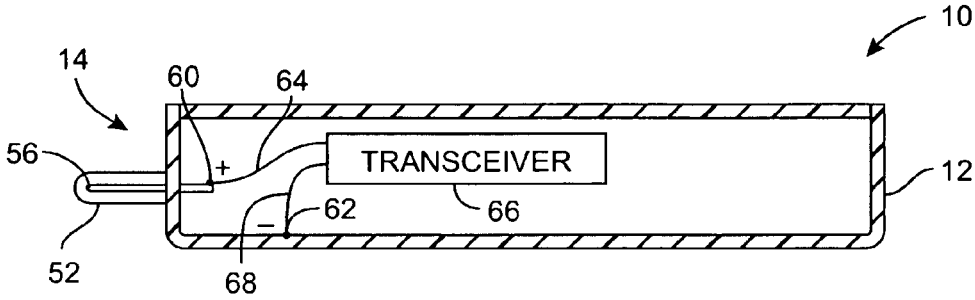
FIG. 6 is a cross-sectional side view of an illustrative handheld electronic device with a button antenna showing how a radio-frequency transceiver is coupled to the button antenna in accordance with the present invention.

A side view of an illustrative handheld electronic device 10 is shown in FIG. 6. As shown in FIG. 6, handheld electronic device 10 may contain a radio-frequency (RF) transceiver 66 (e.g., as part of wireless communications devices 44 of FIG. 4). Transceiver 66 may be electrically connected to the components of antenna 14 via conductive paths such as paths 64 and 68. Path 64 is connected between the transceiver 66 and the antenna's feed (positive terminal) at connection region 60 on resonating element 56. The negative or ground connection of the antenna is made by connecting transceiver 66 to case 12 using conductive path 68. Conductive path 68 may be connected to case 12 using connecting structure 62 (e.g., solder, a spring, a spring-loaded pin, etc.).

Paths 64 and 68 may be implemented using any suitable arrangement. With one illustrative arrangement, paths 64 and 68 are formed at least partly using coaxial cable. With another illustrative arrangement, paths 64 and 68 are formed from a strip of flex circuit on which conductive paths have been formed. Paths 64 and 68 may also be formed using circuit board traces, using wires, or using any other suitable conductive structures.

A user of handheld electronic device 10 can place button antenna 14 in its deployed and undeployed state, as desired. Any suitable mechanical button mechanism may be used. With one suitable arrangement, which is sometimes described herein as an example, button antenna 14 is formed using a pushbutton arrangement. This allows a user to deploy and recess the button by pressing the surface of the button. With one press, the button is deployed outward. With another press, the button is pushed inward until its surface lies flush with the surface of the case (as an example).

Figure 7:
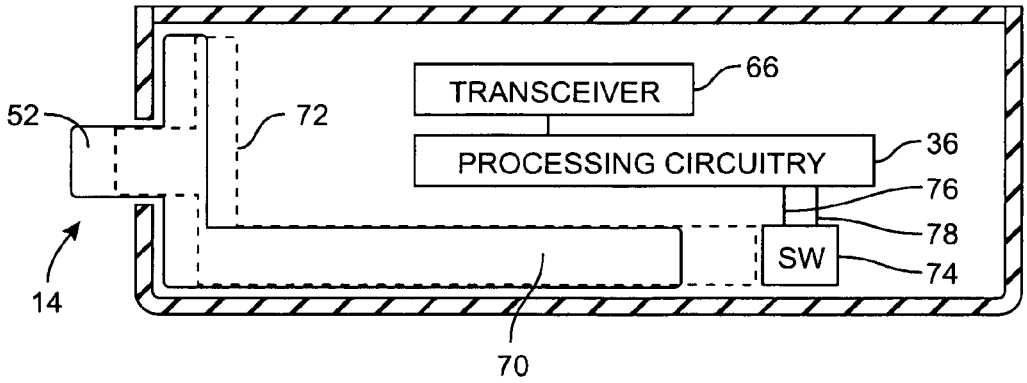
FIG. 7 is a cross-sectional side view of an illustrative handheld electronic device containing an illustrative switch for detecting the position of a button antenna in accordance with present invention.

FIG. 7 shows illustrative button member 52 that has extending arm 70. The position of arm 70 (and therefore the position of button antenna 14) may be sensed using switch 74 that is connected to processing circuitry 36 using conductive paths (e.g., wires) 76 and 78. When button antenna 14 of FIG. 7 is in its deployed position, arm 70 is separated from switch 74. In this situation, processing circuitry 36 can sense that switch 74 is forming an open circuit (as an example). When button antenna 14 of FIG. 7 is in its undeployed position, arm 70 can be placed in the position indicated by dotted line 72. In this situation, arm 70 is in close proximity to switch 74 and causes switch 74 to form a closed circuit. Processing circuitry 36 can detect when switch 74 closes, so that processing circuitry 36 can conclude that button antenna 14 is in its undeployed (recessed) state.

Switch 74 can be formed using any suitable electronic structure that can sense the location of button antenna 14 (e.g., metal contacts that are forced into and out of contact with each other by pressure from arm 70, magnetic sensors that sense the presence of a magnet attached to button member 52, capacitive sensors, or any other suitable type of switch that can detect a button's position).

In the examples of FIGS. 1, 2, and 3, button antenna 14 is disposed on the upper side of case 12. This is merely one illustrative arrangement.

Figure 8:
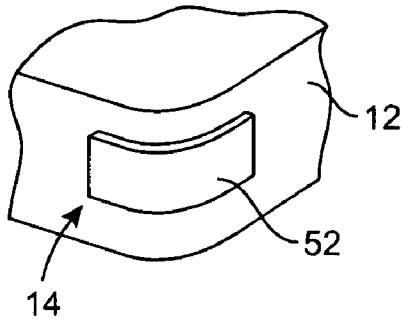
FIG. 8 is a perspective view of an illustrative retracted handheld electronic device button antenna that protrudes from a corner of a conductive case in accordance with the present invention.
Figure 9:
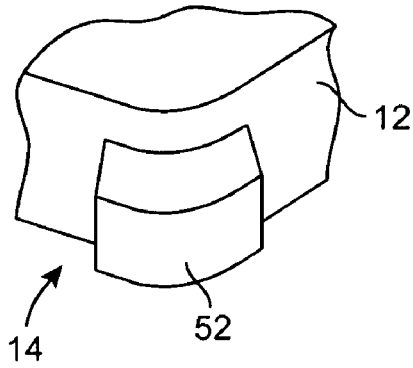
FIG. 9 is a perspective view of an illustrative deployed handheld electronic device button antenna that protrudes from a corner of a conductive case in accordance with the present invention.

As shown in FIGS. 8 and 9, button antenna 14 may be formed from button member 52 that moves in and out of a corner of case 12. In FIG. 8, button antenna 14 and button member 52 are shown in an undeployed position. In FIG. 9, button antenna 14 and button member 62 have been deployed (e.g., by pressing on the undeployed button of FIG. 8).

Figure 10:
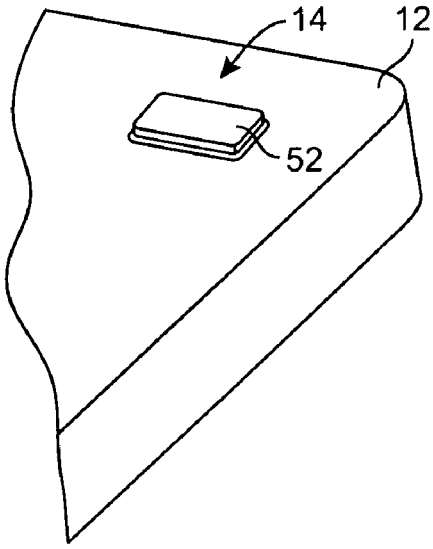
FIG. 10 is a perspective view of an illustrative retracted handheld electronic device button antenna that protrudes from a front or rear surface of a conductive case in accordance with the present invention.
Figure 11:
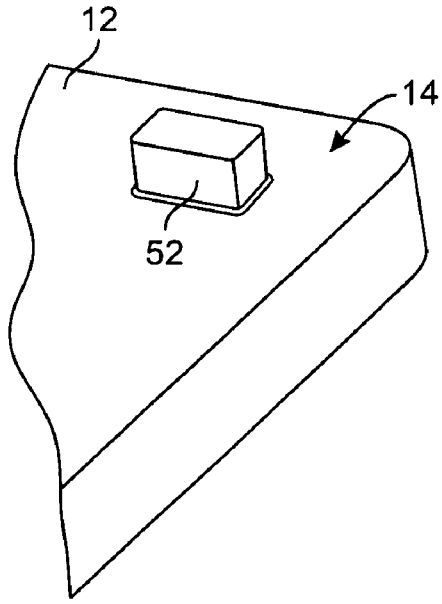
FIG. 11 is a perspective view of an illustrative deployed handheld electronic device button antenna that protrudes from a front or rear surface of a conductive case in accordance with the present invention.

As shown in FIGS. 9 and 10, button antenna 14 may be formed from a button member 52 that moves in and out of the front or rear surface of case 12. In FIG. 10, button antenna 14 and button member 52 are shown in an undeployed position in which the top surface of button member 52 is nearly even with the front surface of case 12 (i.e., the surface of case 12 that may contain a display such as display 16 of FIG. 1 and a user interface such as user input interface 18 of FIG. 1). In FIG. 11, button antenna 14 and button member 62 have been deployed (e.g., in response to pressing button member 52 of FIG. 10).

Figure 12:
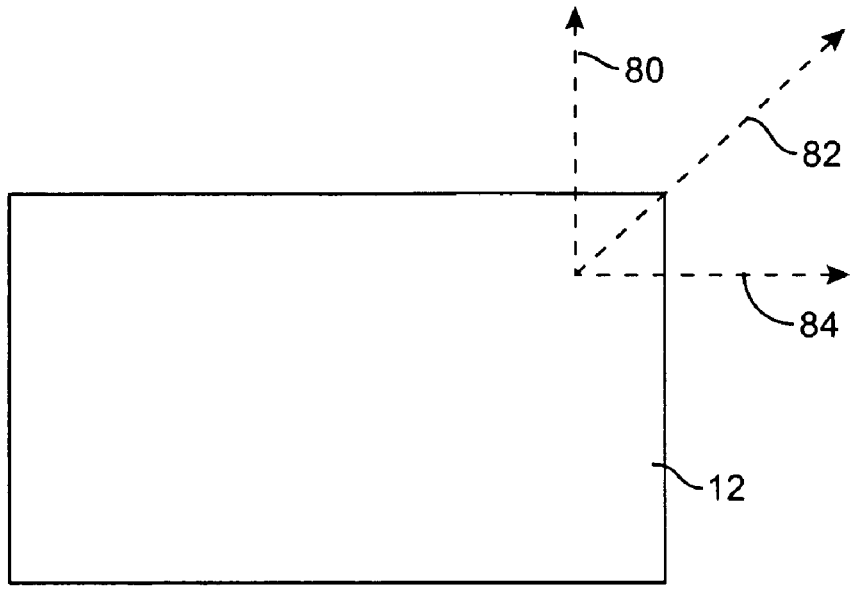
FIG. 12 is a schematic top view of an illustrative handheld electronic device case showing possible directions of travel for button antennas in accordance with the present invention.
Figure 13:
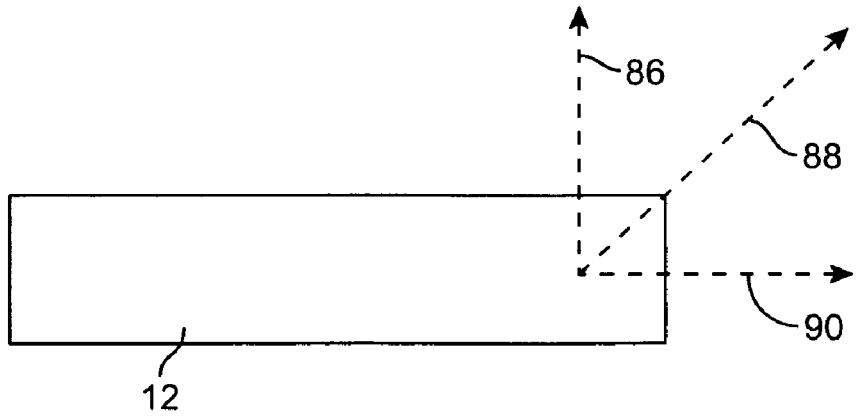
FIG. 13 is a schematic side view of an illustrative handheld electronic device case showing possible directions of travel for button antennas in accordance with the present invention.

It is not necessary for button antenna 14 to move in a direction that is perpendicular to a surface of case 12. FIG. 12 shows a top view of a handheld electronic device case 12. Dotted arrows 80, 82, and 84 illustrate some of the possible directions along which button antenna 14 can reciprocate or otherwise extend. FIG. 13 shows a side view of a handheld electronic device case 12 and illustrates additional possible directions 86, 88, and 90 along which button antenna 14 can reciprocate. In general, button 12 can reciprocate along any of the directions shown in FIG. 12, any of the directions shown in FIG. 13, any combination of the directions shown in FIGS. 12 and 13, or any other suitable direction.

The example of FIG. 5 shows how resonating element 54 may be formed using an L-shaped conductor 56. This is merely one illustrative arrangement for forming resonating element 54.

Figure 14:
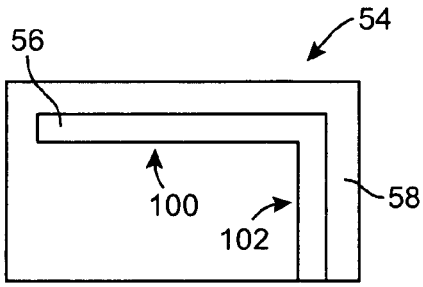
FIG. 14 is a top view of an illustrative handheld electronic device button antenna formed using a "L" structure in accordance with the present invention.

FIG. 14 shows an example of resonating element 54 that can be formed from L-shaped conductor 56 similar to the arrangement of FIG. 5. When button member 52 is relatively long and thin in the dimensions along the surface of case 12, it may be advantageous to use an L-shaped antenna of the type shown in FIG. 14 in which the outer portion 100 of the L is longer than the inner portion 102.

Figure 15:
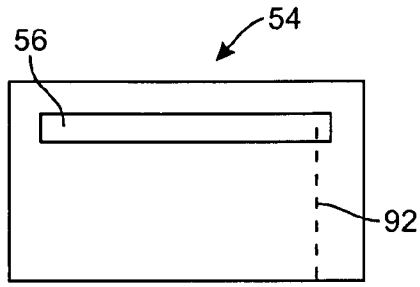
FIG. 15 is a top view of an illustrative handheld electronic device button antenna formed using a conductive strip in accordance with the present invention.

FIG. 15 shows an example of a resonating element 54 that is formed using a conductive strip. As shown by dotted line 92, a conductive path such as a coaxial cable feed electrode is used to convey signals to the strip-shaped conductor 56.

Figure 16:
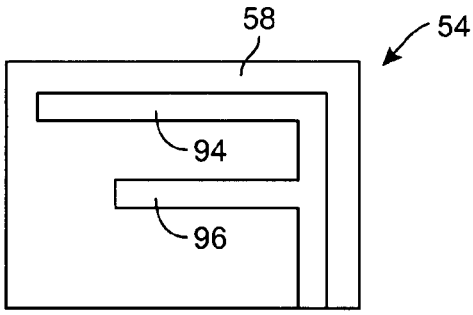
FIG. 16 is a top view of an illustrative handheld electronic device button antenna formed using a structure with multiple conductive arms in accordance with the present invention.

In the example of FIG. 16, resonating element 54 is formed from an F-shaped structure having arms 94 and 96. The lengths of the arms 94 and 96 may be the same or may be different and may be chosen to adjust the bandwidth and efficiency of the antenna design.

Figure 17:
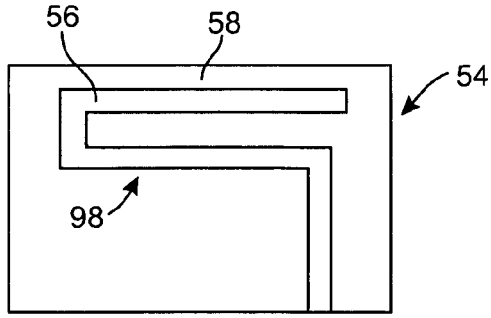
FIG. 17 is a top view of an illustrative handheld electronic device button antenna formed using a zig-zag or meandering path structure in accordance with the present invention.

FIG. 17 shows an example of a resonating element 54 that is based on a zig-zag structure 98.

The substrates used in antennas of the type shown in FIGS. 14, 15, 16, and 17 may be printed circuit board material or any other suitable dielectric substrate, as described in connection with FIG. 5.

Figure 18:
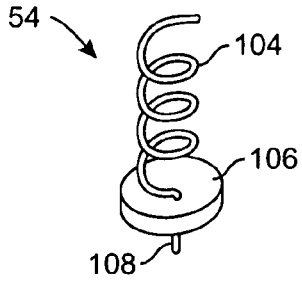
FIG. 18 is a perspective view of an illustrative handheld electronic device button antenna formed using a helical conductor structure in accordance with the present invention.

Another illustrative arrangement for resonating element 54 is shown in FIG. 18. In the FIG. 18 example, resonating element 54 is formed from a length of conductor 104 that has been formed into a spiral (helix). Conductor 104 may be, for example, wire that is mounted to base 106 and to which electrical contact may be made at feed terminal 108.

Figure 19:
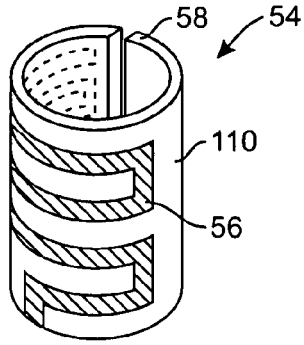
FIG. 19 is a perspective view of an illustrative handheld electronic device button antenna formed using a curled portion of flex circuit board in accordance with the present invention.

If desired, resonating element 54 for button antenna 12 may be formed using a flexible substrate that has been formed into a three-dimensional structure. This type of arrangement is shown in FIG. 19. As shown in FIG. 19, flexible substrate 58 may be curled together to form a cylindrical structure. Meandering conductive trace 56 may be formed on top of flexible substrate 58 before the substrate is curled.

Figure 20:
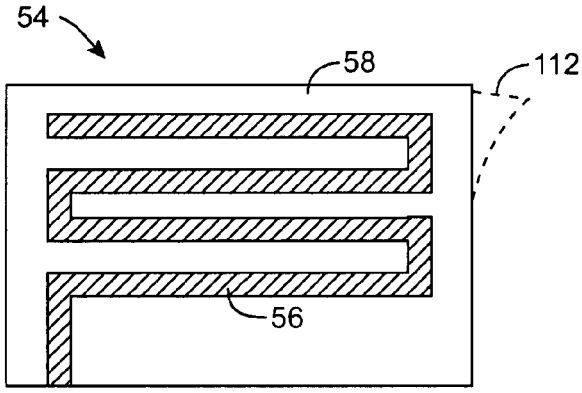
FIG. 20 is a view of an illustrative handheld electronic device button antenna formed using a zig-zag structure on a substrate such as a flex circuit substrate in accordance with the present invention.

As shown in FIG. 20, resonating element 54 may be constructed using a conductive trace 56 that forms a zig-zag or meandering pattern on the surface of substrate 58. If substrate 58 is flexible, resonating element 54 may be bent as shown by dotted line 112. With this type of arrangement, resonating element 54 may be shaped to conform to the inner surface of hollow button member 52.

Figure 21:
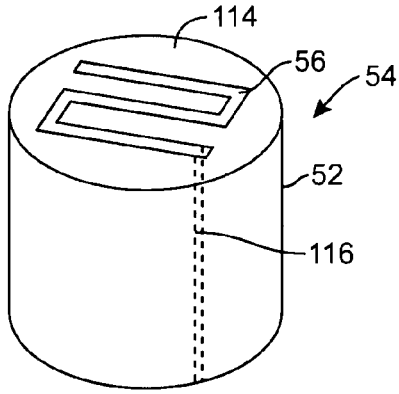
FIG. 21 is a perspective view of an illustrative handheld electronic device button antenna formed using a zig-zag structure contained in a plane that is parallel with a rounded or circular button's top surface in accordance with the present invention.

Conductive path 56 is used to form the resonating element 54 may lie in a plane that is substantially parallel to the top surface 114 of bottom member 52, as shown in FIG. 21. Conductive path 116, such as a coaxial cable center conductor, may be used to form an electrical connection with the zig-zag path traced out by conductor 56.

Figure 22:
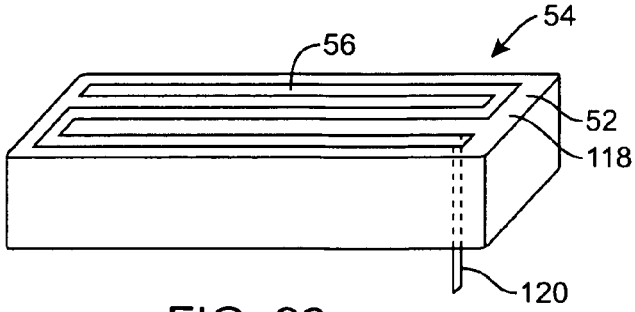
FIG. 22 is a perspective view of an illustrative handheld electronic device button antenna formed using a zig-zag structure contained in a plane that is parallel with a rectangular button's top surface in accordance with the present invention.

FIG. 22 shows illustrative radiating element 54 that can be formed using conductive path 56 that is shaped to conform to rectangular upper surface 118 of a button member 52. A conductive path such as conductive path 120 may be used to form the antenna's feed terminal.

Button antenna 14 moves during use. With one suitable arrangement, a flexible conductor is used to ensure that adequate electrical contact is maintained between transceiver 66 and antenna 14. In particular, a flexible conductive path may be used to ensure that resonating element 54 (and particularly conductor 56) remains electrically connected to transceiver 66 at all times and that the antenna ground formed from case 12 remains connected at all times. The electrical path between transceiver 66 and the antennas positive or feed terminal formed by conductor 56 and resonating element 54 is shown schematically by line 64 in FIG. 6. Line 68 in FIG. 6 is a schematic representation of the electrical path between transceiver 66 and the antenna's ground terminal formed, for example, by case 12 or other suitable grounding electrode structure.

Figure 23:
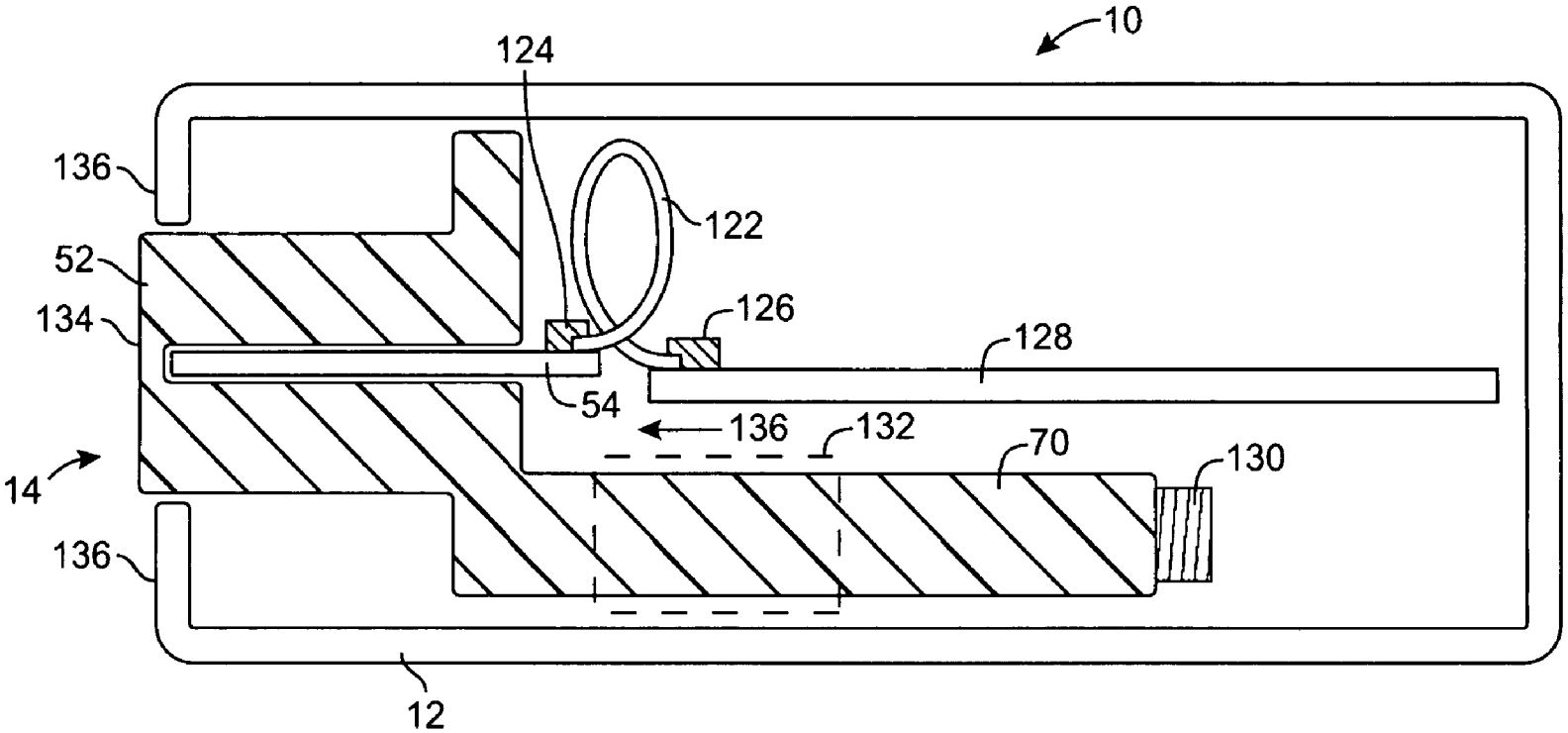
FIG. 23 is a cross-sectional side view of an illustrative handheld electronic device button antenna in a retracted position in accordance with the present invention.
Figure 24:
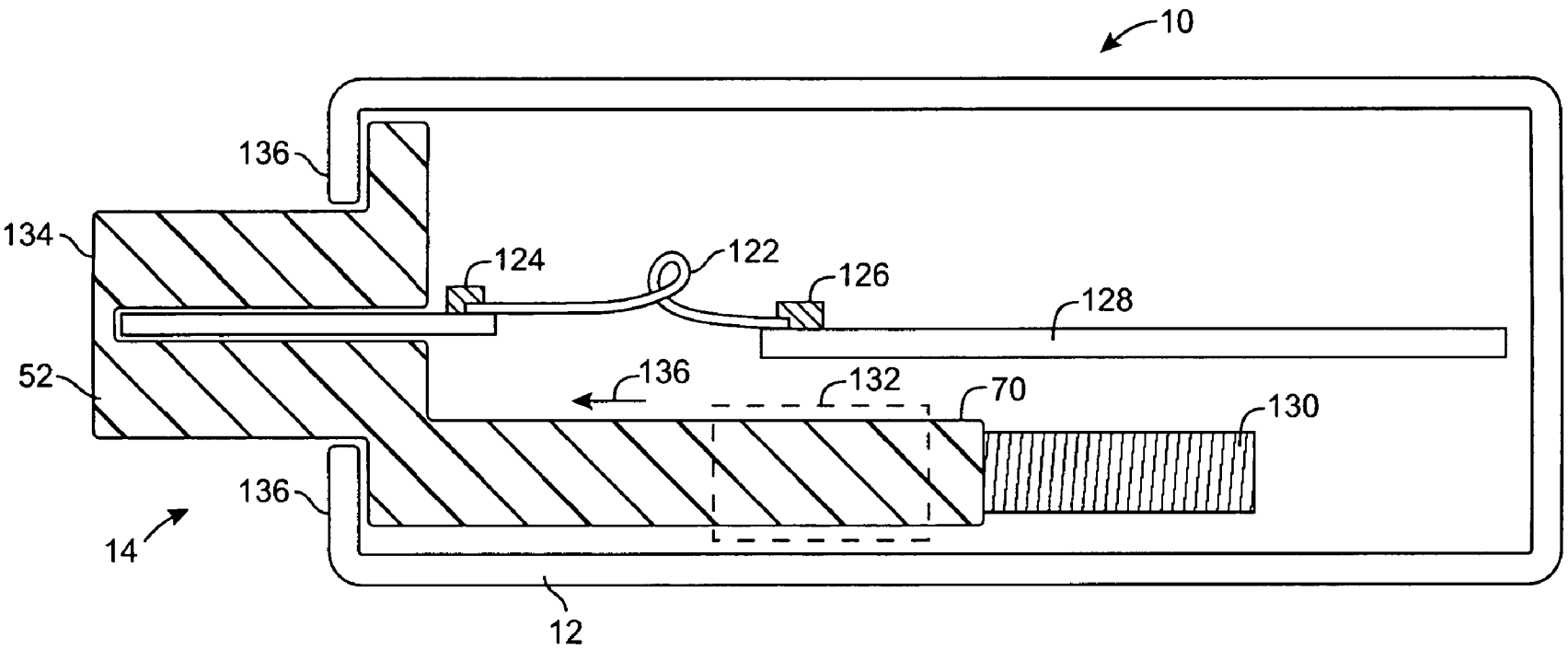
FIG. 24 is a cross-sectional side view of an illustrative handheld electronic device button antenna in a deployed position in accordance with the present invention.

FIGS. 23 and 24 show side views of illustrative handheld electronic device 10 that uses a flexible conductor arrangement based on a coaxial cable. In the situation shown in FIG. 23, button member 52 is in its undeployed state, so that button top surface 134 lies nearly even with the top side surface 136 of case 12. In the situation shown in FIG. 24, button member 52 is in its deployed state, so the button top surface 134 protrudes significantly from the surface 126.

Circuitry 128 may be, for example one or more circuit boards populated with one or more integrated circuits, such as integrated circuits for implementing RF transceiver 66, processing circuitry 36, etc. Coaxial cable 122 may be electrically and structurally connected to resonating element 54 and circuitry 128 using direct solder connections, micro-coaxial connectors 124 and 126, or any other suitable connection structures.

Cable 122 forms a loop between resonating element 54 and circuitry 128. Slack in the loop of cable 122 allows button member 52 to move between its deployed and undeployed positions without breaking the electrical connection between resonating element 54 and circuitry 128. When the button antenna is undeployed, the loop of cable 122 has a considerable amount of slack, as shown by the relatively large size of the loop in FIG. 23. When the button antenna is deployed, the loop of cable 122 has less slack, as shown by the relatively small size of the loop of cable 122 in FIG. 24.

Arm 70 of button member 52 extends through switch mechanism 132 and is biased in direction 136 by spring 130. Switch mechanism 132 may be any suitable latching mechanism for controlling the latching operation of button antenna 14. With one suitable arrangement, which is described as an example, switch mechanism 132 and spring 130 form a pushbutton mechanism. A pushbutton mechanism allows button antenna 14 to be controlled by finger pushes from a user. When a button antenna in the undeployed state is pressed, a pushbutton-type switch mechanism 132 can release the button and allow spring 130 to deploy the button outward. When a button antenna in the deployed state is pressed, a pushbutton-type switch mechanism 132 can capture the button member arm 70 after the button has reached its recessed position.

The illustrative arrangement of FIGS. 23 and 24 can use a flexible coaxial cable with a loop to make electrical contact between radiating element 54 and circuitry 128 such as the transceiver 66. If desired, other flexible conductive path arrangements may be used to couple resonating element 54 and ground 12 to transceiver 66.

Figure 25:
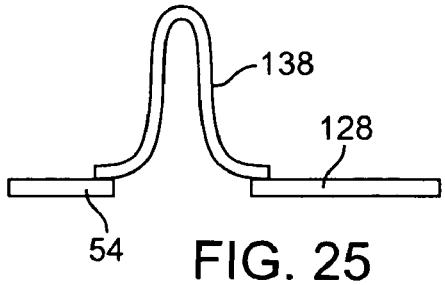
FIG. 25 is a cross-sectional side view of an illustrative button antenna connected to an illustrative circuit board in a handheld electronic device by an upwardly extended flexible conductive path in accordance with the present invention.
Figure 26:
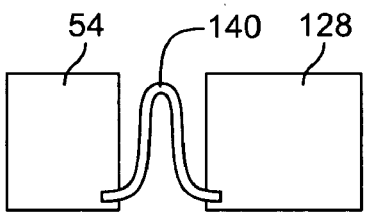
FIG. 26 is a top view of an illustrative button antenna connected to an illustrative circuit board in a handheld electronic device by a laterally-extending flexible conductive path in accordance with the present invention.
Figure 27:
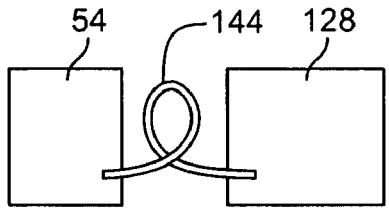
FIG. 27 is a top view of an illustrative button antenna connected to an illustrative circuit board in a handheld electronic device by a laterally-extending flexible conductive path with a loop in accordance with the present invention.

FIG. 25 shows a side view of an illustrative flexible electrical coupling arrangement based on flexible conductor 138 that has a bend rather than a loop. In the example of FIG. 25, flexible conductive path 138 extends upward from the surfaces of resonating element 54 and circuitry 128. An alternative arrangement is shown in the top view of FIG. 26. In the arrangement of FIG. 26, flexible conductive path 140 has a bend that lies in the same plane as the surfaces of resonating element 54 and circuitry 128. The illustrative arrangement of FIG. 27 is similar to the arrangement of FIG. 26, except that the flexible conductive path 144 of FIG. 27 has a loop, whereas path 140 in FIG. 26 has a bend without a loop.

Figure 28:
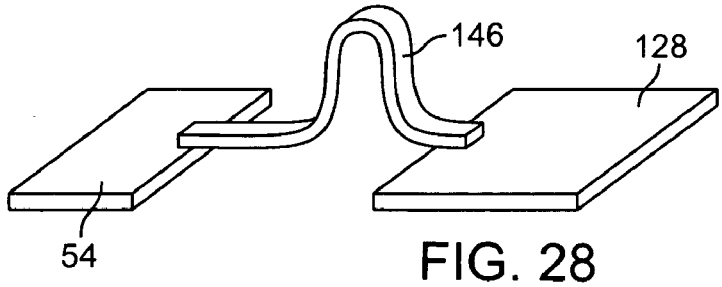
FIG. 28 is a perspective view of an illustrative button antenna connected to an illustrative circuit board in a handheld electronic device by an upwardly-extending flexible conductive path formed from a strip of flexible substrate in accordance with the present invention.
Figure 29:
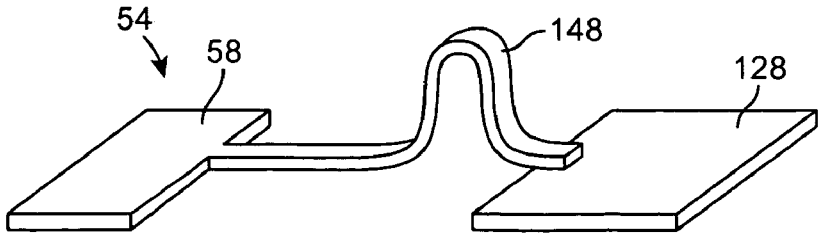
FIG. 29 is a perspective view of an illustrative button antenna connected to an illustrative circuit board in a handheld electronic device by an upwardly-extending flexible conductive path formed from a strip of flexible substrate that is integral with the button antenna's resonating element's substrate material in accordance with the present invention.

The flexible electrical conductor may be coaxial cable or may be formed from conductors on a flexible planar substrate (e.g., polyimide, etc.). An illustrative flexible electrical coupling arrangement based on a flexible planar substrate 146 is shown in FIG. 28. In the example of FIG. 29, flexible electrical conductor 148 is formed as an integral portion of substrate 58 from which resonating element 54 is formed. Flexible electrical conductor 148 may also be formed from an integral portion of a substrate that is used to mount the transceiver 66 or other circuitry 128.

Button antenna 14 can have at least one feed terminal (formed from resonating element 54) and at least one ground terminal. The ground terminal may be formed by any suitable ground conductor. With one suitable arrangement, the ground conductor for button antenna 14 is formed from conductive case 12. Case 12 may be formed from any suitable material, such as metal, conductive polymers, etc. With one particularly suitable arrangement, case 12 is formed from 304 stainless steel. Stainless steel has a high conductivity and can be polished to a high-gloss finish so that it has an attractive appearance. As described in connection with FIG. 6, paths such as paths 64 and 68 can be used to respectively connect the antenna's feed and ground to the transceiver 66.

Figure 30:
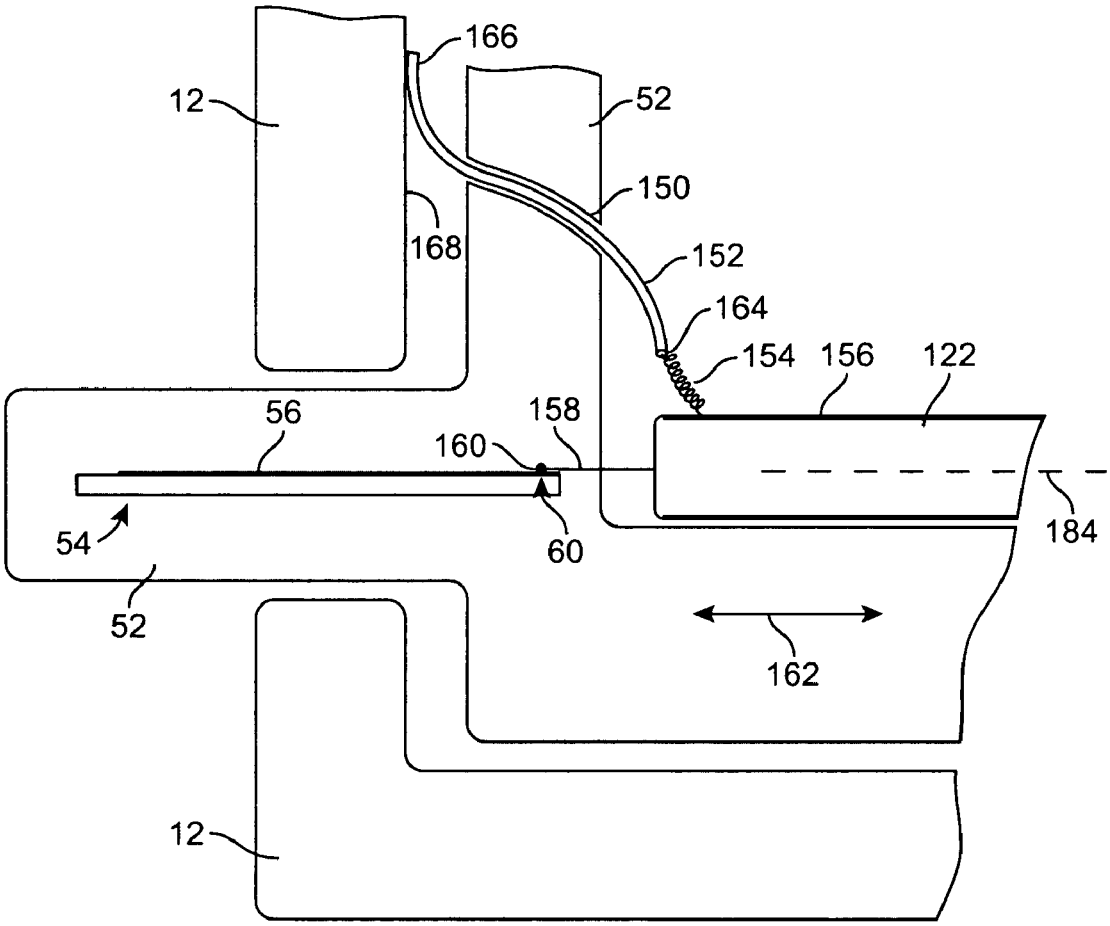
FIG. 30 is a cross-sectional side view of an illustrative button antenna showing how a coaxial cable or other flexible conductive path can be coupled to the antenna's radiating element and a ground plane formed from a handheld electronic device case using a spring structure in accordance with the present invention.

A cross-sectional side-view of an illustrative electrical connecting arrangement for the antenna's feed and ground is shown in FIG. 30. As shown in FIG. 30, button antenna 14 can have a button member 52 that reciprocates along axis 162 parallel to the longitudinal axis 184 of handheld electronic device 10. In the configuration of FIG. 30, button antenna 14 is deployed, so there must be a satisfactory electrical connection between transceiver 66 (FIG. 6) and the antenna's feed and ground. One end of coaxial cable 122 is connected to the transceiver. The other end of the coaxial cable 122 is connected to resonating element 54 and case 12.

As shown in FIG. 30, coaxial cable 122 has a center conductor 158 and coaxial ground conductor 156. Center conductor 158 is typically a copper wire. Ground conductor 156 is typically a copper braid.

A portion of the copper braid (copper braid extension 154) may be soldered to spring 152 with solder 164. Spring 152 may be mounted in slot 150 in button member 52. When button antenna 14 is deployed, end 166 of spring 152 presses against the inner surface 168 of case 12 and makes a good, low resistance electrical contact between ground conductor 156 of coaxial cable 122 and the antenna's ground electrode formed by case 12.

Center conductor 158 may be soldered to conductive path 56 of resonating element 54 with solder 160 at contact region 60. Coaxial cable 122 may be attached to button member 52 using epoxy or another suitable adhesive, a mounting clip, or any other suitable attachment structure.

Figure 31:
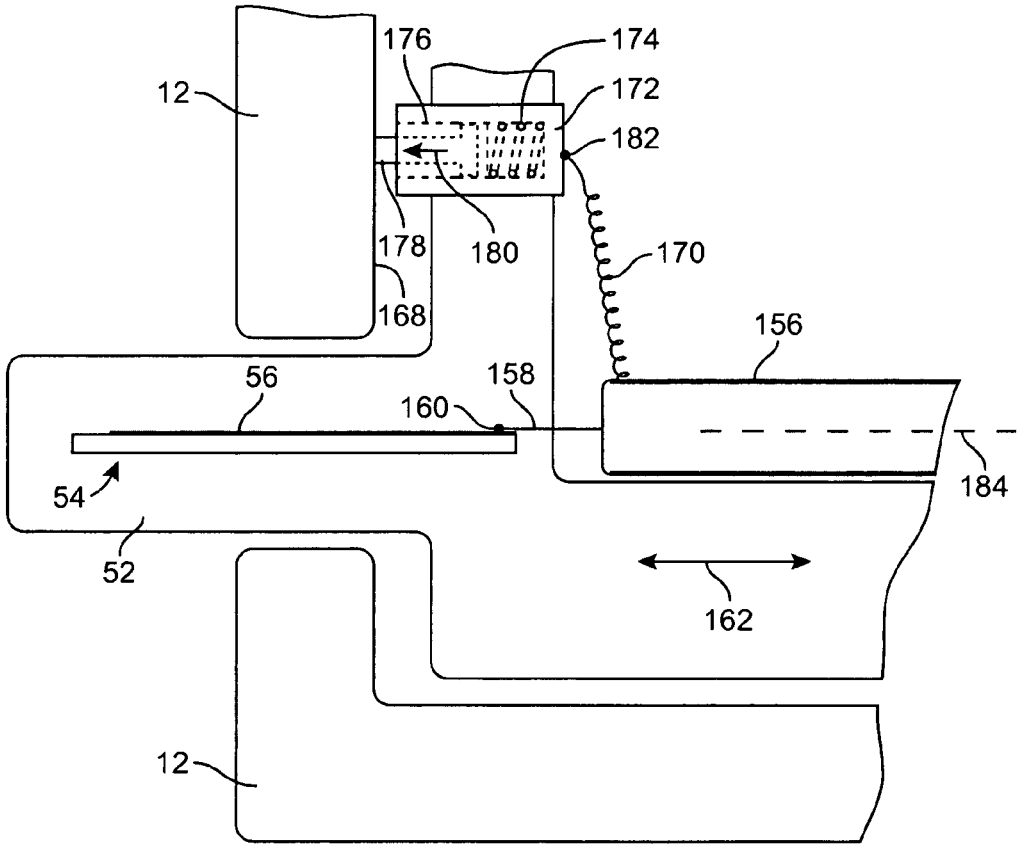
FIG. 31 is a cross-sectional side view of an illustrative button antenna showing how a coaxial cable or other flexible conductive path that is disposed along a handheld electronic device's longitudinal axis can be coupled to the antenna's radiating element and a ground plane formed from a handheld electronic device case using a spring-loaded pin in accordance with the present invention.

A cross-sectional side-view of an illustrative electrical connecting arrangement for the antenna's feed and ground that is based on a spring-loaded pin is shown in FIG. 31. As shown in FIG. 31, center conductor 158 of coaxial cable 122 may be soldered to conductive path 56 of resonating element 54 with solder 160.

A suitable conductor 170 such as a portion of copper braid 156 may be soldered to spring-loaded pin 172 with solder 182. Pin 172 may be mounted in a slot in button member 52. A spring 174 in a cylindrical hollow inner portion 176 of pin 172 biases reciprocating pin member 178 in direction 180. When button antenna 14 is deployed as shown in FIG. 31, the tip of the reciprocating pin member 178 presses against the inner surface 168 of case 12 and makes a low-resistance electrical contact between the ground conductor 156 of the coaxial cable 122 and case 12.

Figure 32:
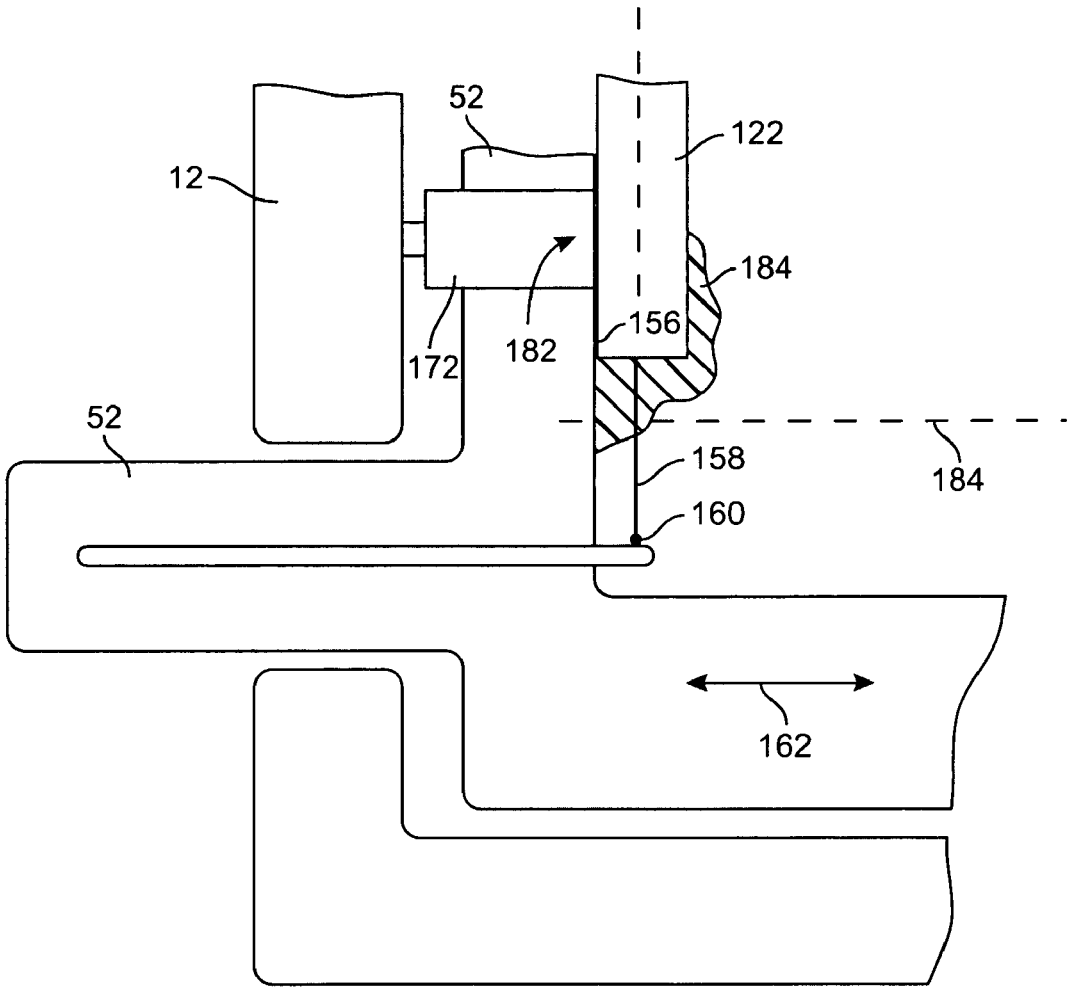
FIG. 32 is a cross-sectional side view of an illustrative button antenna showing how a coaxial cable or other conductive path that is disposed perpendicular to a handheld electronic device's longitudinal axis can be coupled to the antenna's radiating element and a ground plane formed from a handheld electronic device case using a spring-loaded pin in accordance with the present invention.

In the illustrative arrangement of FIG. 32, ground conductor 156 of coaxial cable 122 is soldered to pin 172 in region 182. As shown in FIG. 32, epoxy 184 or other suitable adhesive or attachment structure may be used to attach coaxial cable 122 to button member 52.

Figure 33:
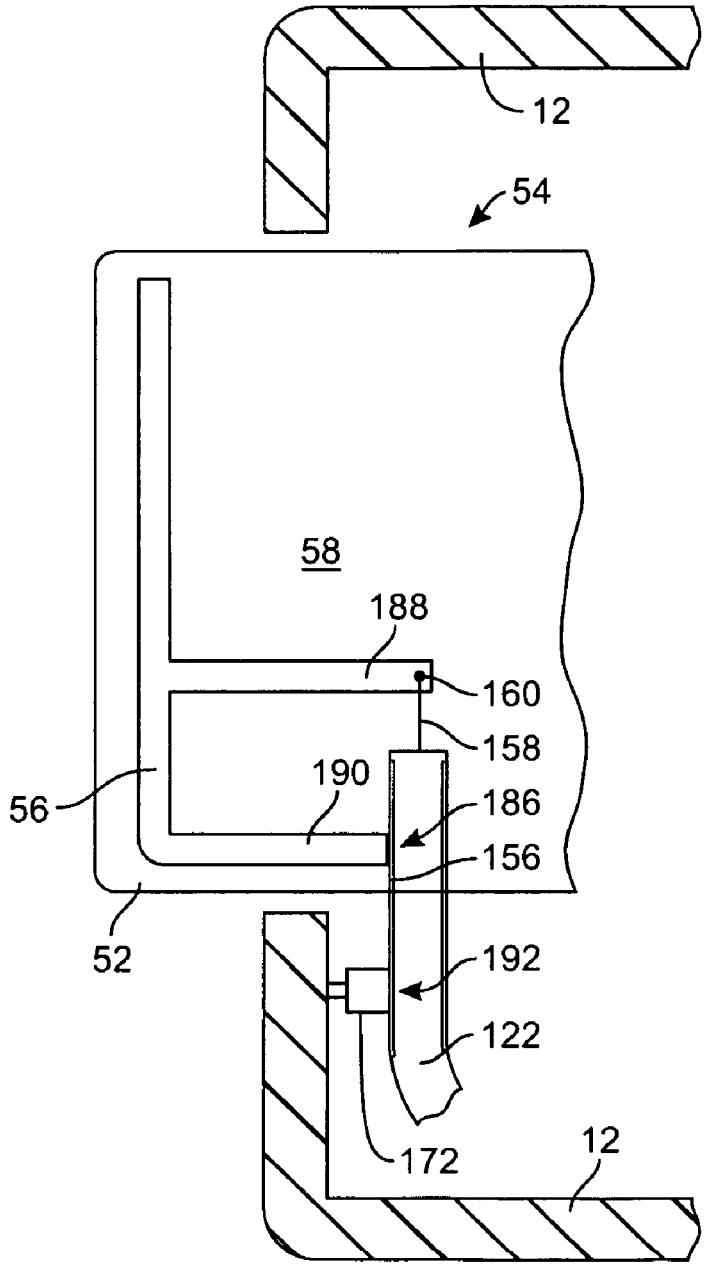
FIG. 33 is a cross-sectional side view of an illustrative button antenna with multiple conductive arms and multiple ground attachment points in accordance with the present invention.

An example of an electrical attachment arrangement for a resonating element with multiple conductive arms is shown in FIG. 33. As shown in FIG. 33, resonating element 54 can have a substrate 58 on which conductive lines 56 such as copper traces can be formed. Conductor 56 can have a first (capacitive) arm 188 and second (inductive) arm 190. Center conductor 158 of coaxial cable 122 may be soldered to arm 188 with solder 160. Ground conductor 156 of coaxial cable 122 can be soldered to arm 190 at solder joint 186. A suitable electrical connection structure, such as spring-loaded pin 172 that is soldered to ground conductor 156 at solder location 192, may be used to make electrical connection between ground conductor 156 and case 12.

Figure 34:
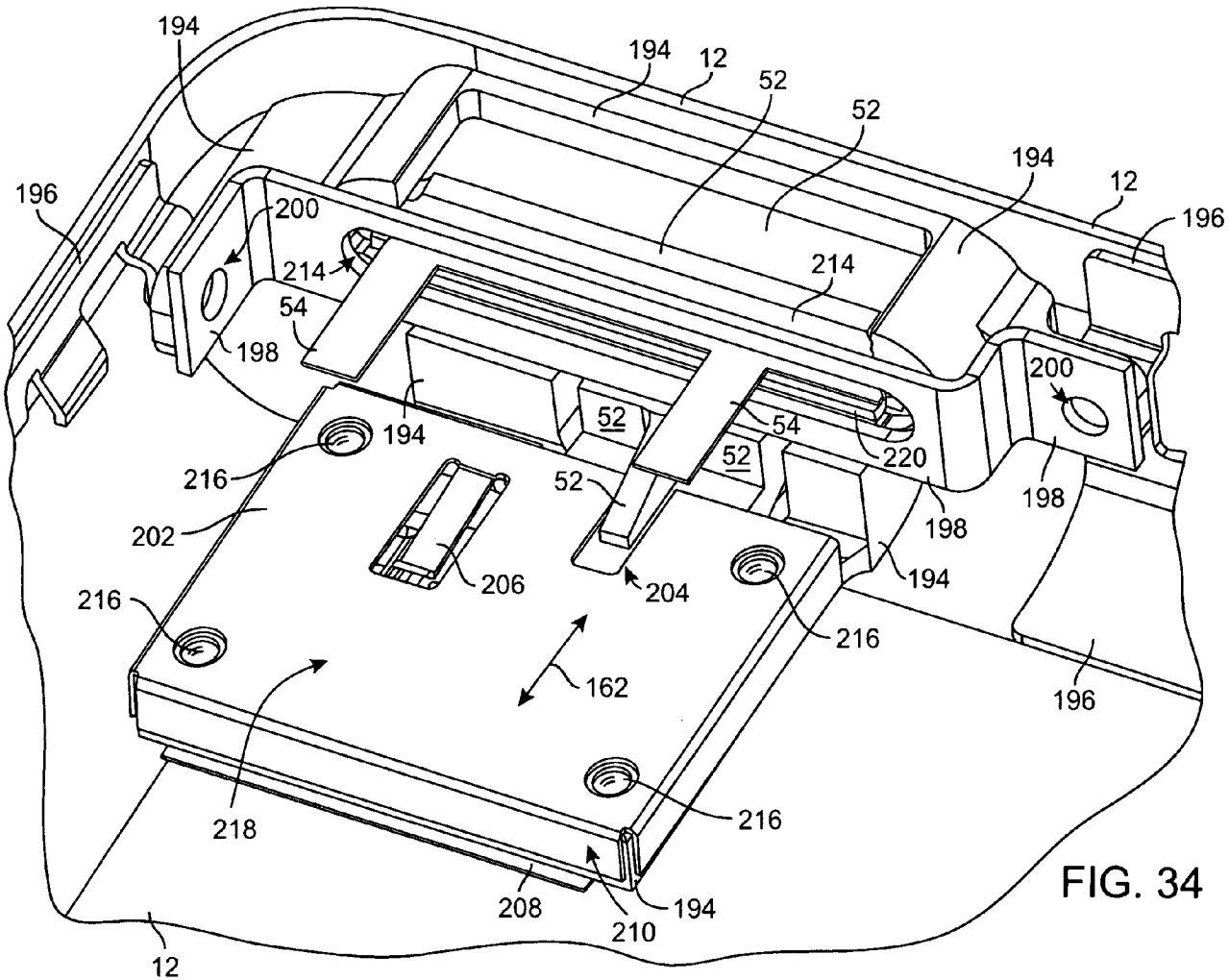
FIG. 34 is a perspective view of an illustrative pushbutton antenna mounted to the case of a handheld electronic device in accordance with the present invention.

A perspective view of an illustrative pushbutton antenna 14 that is mounted to case 12 in a handheld electronic device 10 is shown in FIG. 34. In the mounting arrangement shown in FIG. 34, mounting brackets 196 are attached to case 12. Any suitable attachment mechanism may be used to attach brackets 196 to case 12. With one suitable arrangement, brackets 196 are made of metal and are laser welded to case 12.

A structure such as button trim 194 may be used to guide button member 52. Button member 52 may reciprocate within button trim 194 in directions 162. Because the outer sidewalls of button member 52 may rub against the inner sidewalls of button trim 194, it may be desirable to form button member 52 and button trim 194 from materials that exhibit a low coefficient of friction when rubbed against each other. With one suitable arrangement, button member 52 and button trim 194 can be formed from a lubricious plastic such as a plastic based on acrylonitrile-butadiene-styrene (ABS) copolymers. If desired, button member 52 and button trim 194 may also be formed from polycarbonate-based plastics.

Bracket 198 may be used to prevent button member 52 from traveling too far. When rear surface 214 of button member 52 presses against bracket 198, motion of button member 52 is arrested. Bracket 198 and button trim 194 may have screw holes 200. Brackets 196 may have threaded screw holes. Screws (not shown) may be inserted through screw holes 200 and screwed into place in the threaded screw holes of brackets 196 to attach bracket 198 and button trim 194 to bracket 196. This can maintain bracket 198 and button trim 194 at a fixed location relative to case 12.

Bracket 198 may have opening 214 through which resonating element 54 protrudes. Electrical connection of the button antenna's feed to conductor 56 may be made using arrangements of the types shown in FIG. 23-33 (as an example). Resonating element 54 may be formed using any suitable arrangement, such as a piece of flex circuit backed by a 0.5 mm thick printed circuit board stiffener such as stiffener 220.

Four threaded screw holes 216 are shown in button trim 194, although any number may be used. Screws may be screwed into holes 216 to hold housing cover 202 in place against the button trim 194. If desired, housing cover 202 may be provided with attachment tabs in addition to or instead of using screws to attach housing cover 202 to button trim 194. Housing cover 202 may be formed from any suitable material such as plastic or metal. Suitable plastic covers may be about 0.5 mm in thickness, although any thickness with the necessary strength and/or cosmetic properties is possible. Metal covers may be preferred in some instances, because metal covers can be fabricated with thinner thicknesses (e.g., about 0.15 mm). Using a thinner cover can be advantageous when it is desired to minimize the overall dimensions of handheld electronic device 10.

During assembly, before bracket 198 and button trim 194 have been secured to bracket 196, it may be desirable to secure button trim 194 to housing 12. With one suitable arrangement, double-sided pressure-sensitive adhesive tape 208 or other suitable adhesives may be used to attach button trim 194 to case 12.

A sensor that detects the position of button member 52, such as switch 74 of FIG. 7, may be formed in region 210. Electrical leads, such as leads 76 and 78 of FIG. 7, may be attached to the sensor through holes formed in cover 202.

A button latching mechanism for button antenna 14 may be formed under region 218. With one illustrative arrangement, the latching mechanism can be a push-push button latching mechanism. Bent down portion 206 of cover 202 can form a biasing tab. The biasing tab may be used to hold down a formed wire in the push-push button mechanism.

Figure 35:
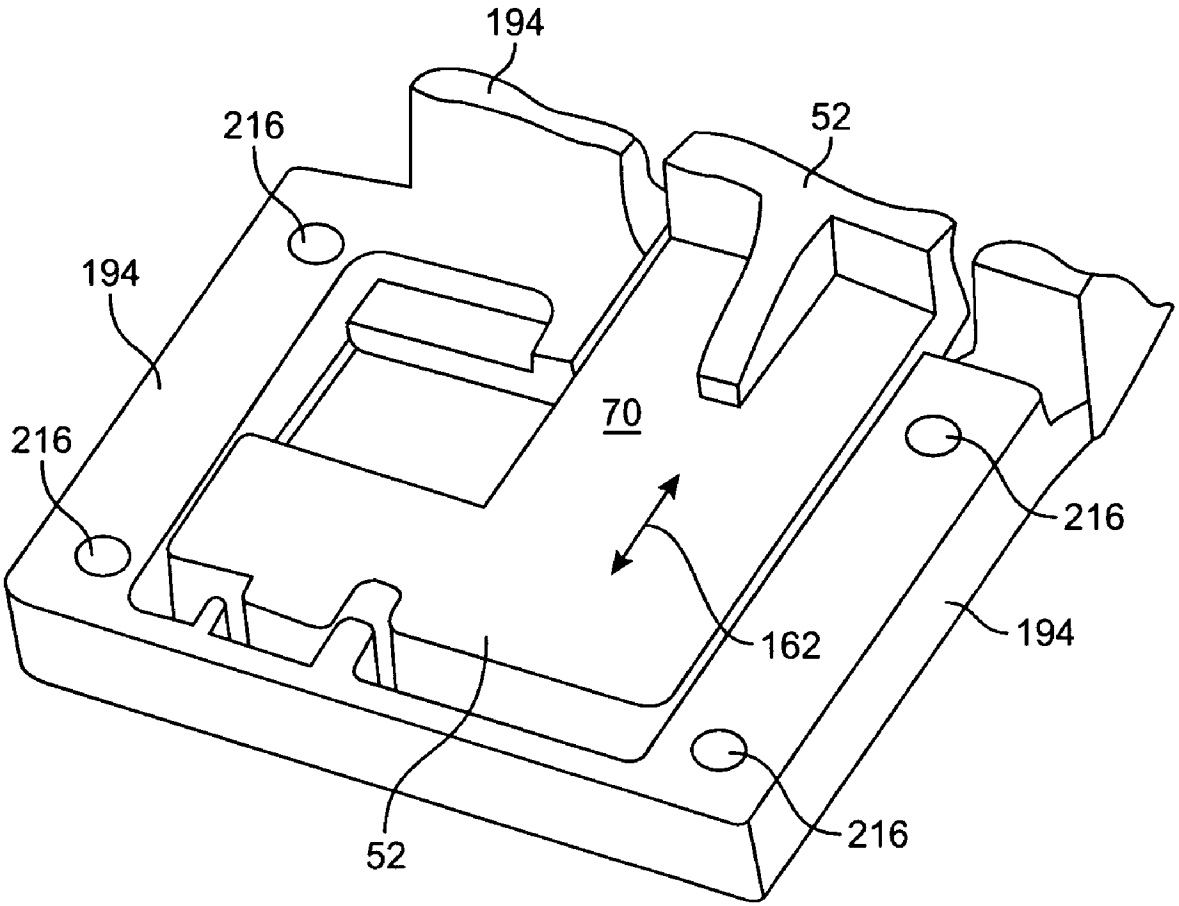
FIG. 35 is a perspective view of an interior portion of an illustrative pushbutton antenna of the type shown in FIG. 34 in which a button arm reciprocates within a button housing in accordance with the present invention.

FIG. 35 shows how portions of an illustrative push-push button latching mechanism may be formed from button trim 194 and button member 52. As a user pushes on button member 52, button member 52 travels back and forth along axis 162. The button trim 194 may form a channel that guides the arm portion 70 of button member 52 as button member 52 reciprocates within trim 194.

Figure 36:
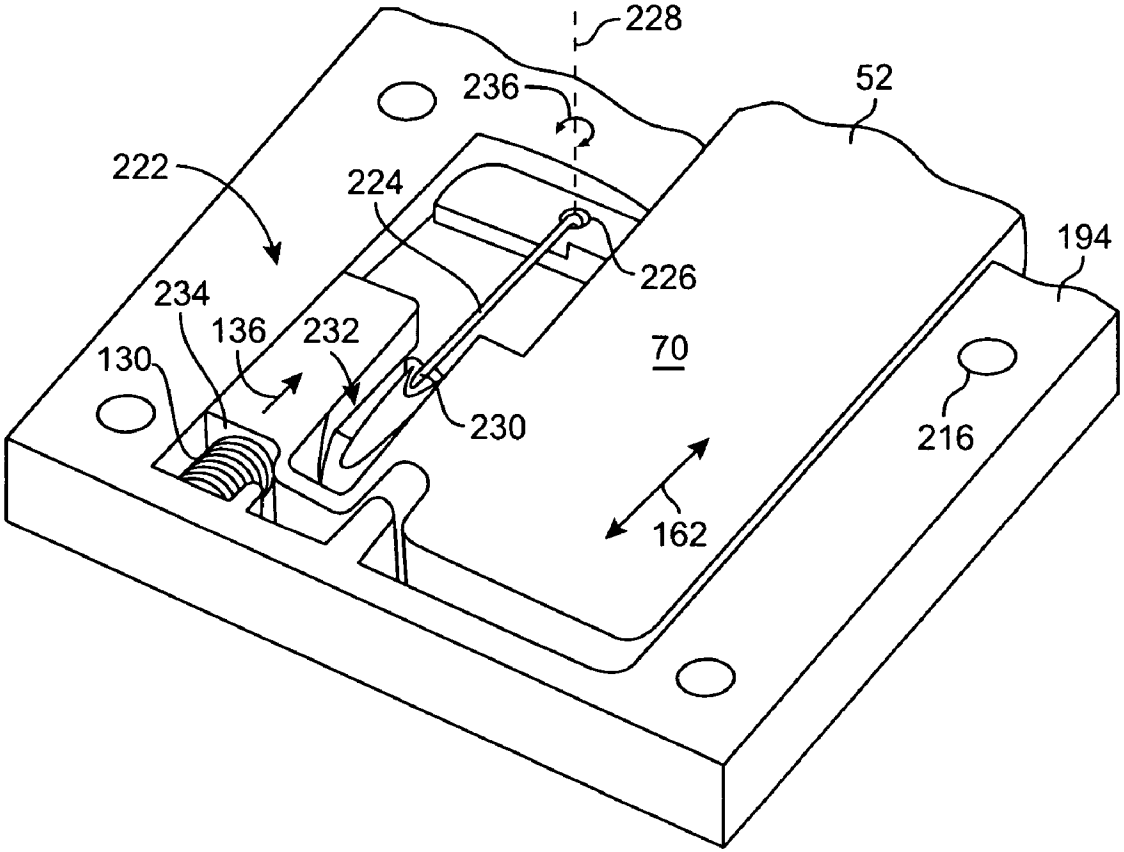
FIG. 36 is a perspective view of an illustrative pushbutton mechanism in an interior portion of an illustrative pushbutton antenna of the type shown in FIG. 34 in accordance with the present invention.

Illustrative push-push latching mechanism 222 that may be used with button antenna 14 is shown in FIG. 36. In the example of FIG. 36, push-push mechanism can have a formed wire 224 (e.g., a stainless steel wire). End 226 of wire 224 is inserted into a hole in button trim 194. During operation of the push-push mechanism, wire 224 can rotate back and forth around rotational axis 228, as indicated by arrows 236, while end 230 of wire 224 can trace out a counterclockwise path in region 232. As described in connection with FIGS. 23 and 24, spring 130 can bias end surface 234 of button member 52 in direction 136.

Figure 37:
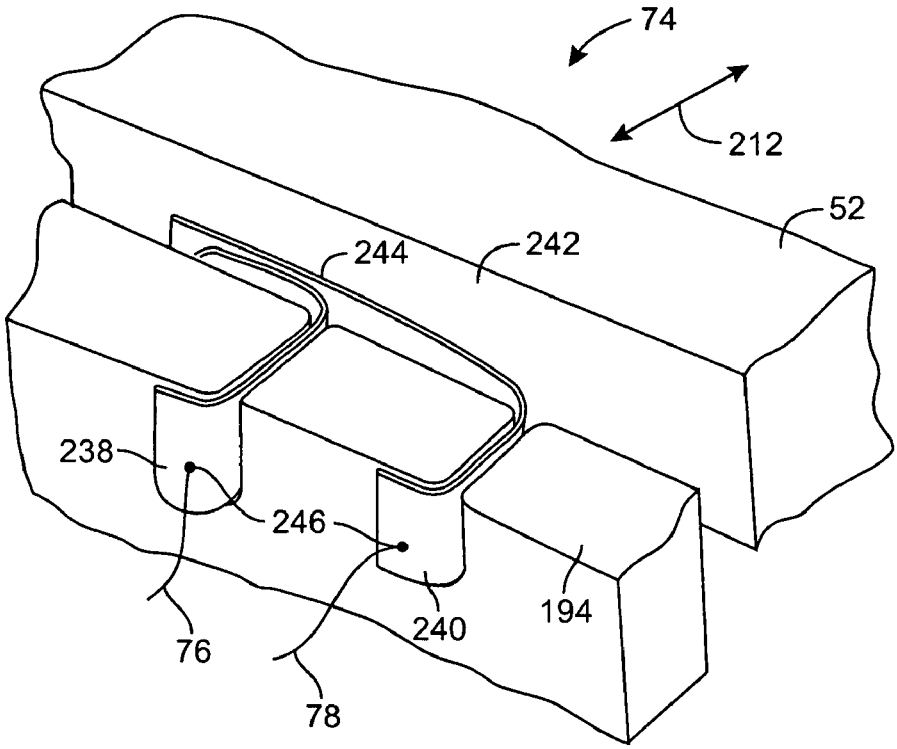
FIG. 37 is a perspective view of an illustrative button switch that may be used to detect the position of a button antenna in accordance with the present invention.

Illustrative switch 74 that may be used with button antenna 14 is shown in FIG. 37. As shown in FIG. 37, switch 74 may be formed from two conductive tabs 238 and 240. Tabs 238 and 240 may be formed, for example, from springy metal strips. When end surface 242 presses against portion 244 of tab 240, tab 240 can be pushed against tab 238, so that tab 238 and tab 240 make electrical contact and form a short circuit. Leads such as wire leads 76 and 78 may be soldered to the protruding ends of tabs 238 and 240 using solder 246. When the tabs are pressed against each other, processing circuitry 36 can detect that button member 52 is in its undeployed position, as described in connection with FIG. 7. When button member 52 is in its deployed position, tabs 238 and 240 form an open circuit between wires 76 and 78, which can be detected by processing circuitry 36. In this situation, processing circuitry 36 can conclude that button antenna 14 has been deployed. The switch sensor arrangement of FIG. 37 is merely illustrative. In general, any suitable sensor may be used to determine the position of button member 152 and button antenna 14.

When button antenna 14 is provided with a sensor such as switch 74 of FIG. 37, the operation of device 10 can be made to depend on the button antenna's position. Processing circuitry, such as processing circuitry 36 of FIG. 7 and FIG. 4, may be used to adjust the functionality of device 10 in response to changes in the button antenna's position. In general, any suitable feature or features of the device may be tied to the button antenna's position. Examples of features and functionality that may be tied to the state of button antenna 14 include transceiver power, display power, handheld electronic device power, RF transmitter power, RF receiver power, wireless communications bit rate or mode (e.g., fast or slow with associated high or low power consumption levels), security (e.g., whether a key is used to encrypt wireless data), audio (e.g., whether present or not), screen backlighting (e.g., illumination level or whether or not present), status indicators (e.g., whether active or inactive), data transfer mode (e.g., whether wired or wireless), port status (e.g., whether or not a wired port is active or inactive), etc.

Figure 38:
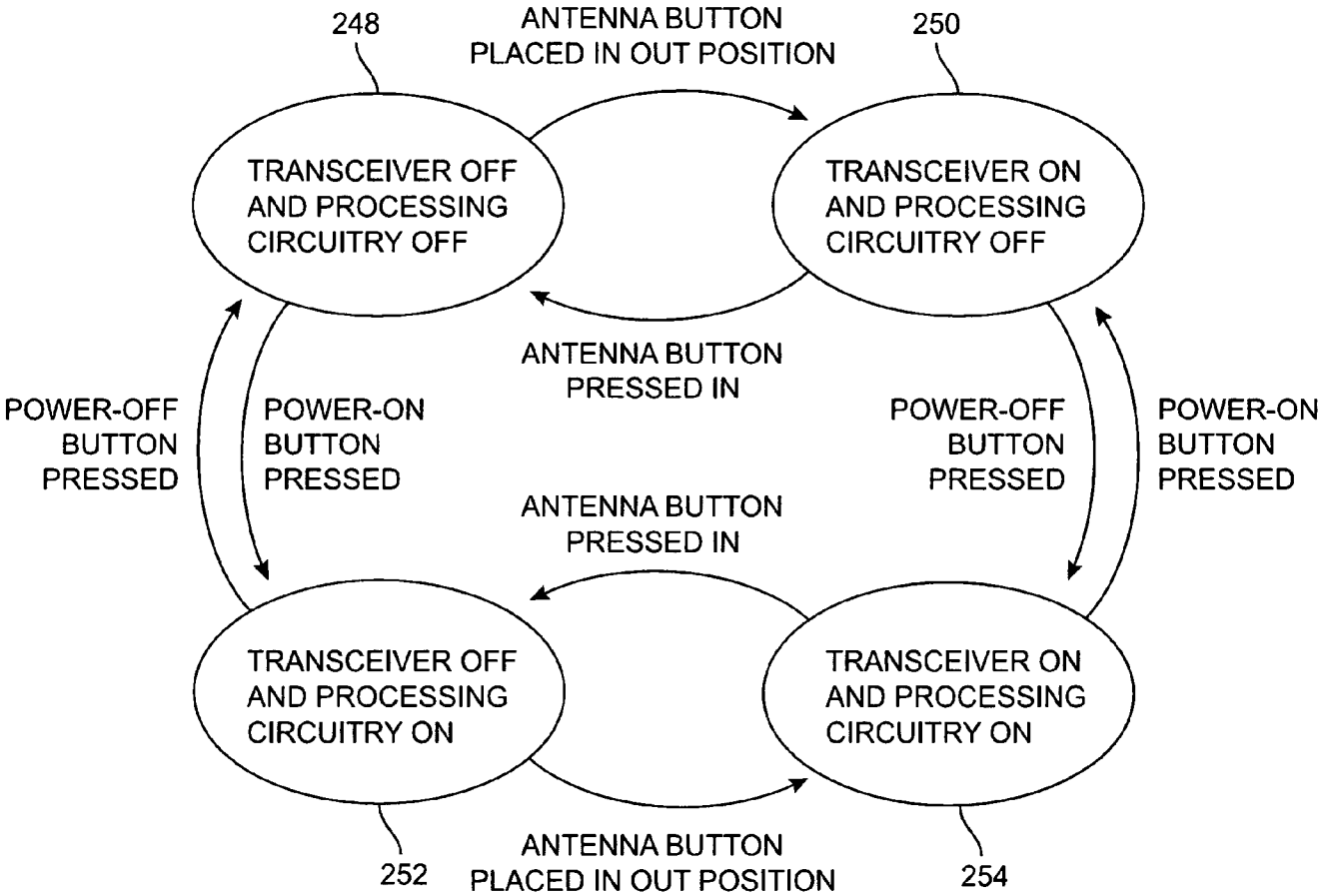
FIG. 38 is a state diagram showing illustrative states and state transitions that may be exhibited during operation of a handheld electronic device containing a pushbutton antenna in accordance with the present invention.

With one suitable arrangement, which is illustrated in FIG. 38 as an example, the position of wireless button antenna 14 controls whether the circuits of RF transceiver 66 (FIG. 6) (and/or other powered wireless communications devices 44 of FIG. 4) are in a high-power ("active" or "on") state or are in a low-power ("off," "standby," "inactive," or "sleep") state. At the same time, the remaining functions in the handheld electronic device 10 (e.g., the functions and circuitry associated with displaying data on display 16, accepting data such as user key pad instructions via input interface 18, playing media using display and audio devices 42, etc.) may be controlled by a separate user input. The separate user input may be, for example, a power on-off button, a power-on button and a power-off button, a set of buttons, one or more soft keys (e.g., buttons formed using keys and associated instructions formed on display 16), on-screen buttons formed on a touch screen, voice-control circuitry that is used to accept voice commands, etc.

As shown in FIG. 38, the handheld electronic device 10 can be operated in at least four distinct states 248, 250, 252, and 254. In state 248, RF transceiver 66 (FIG. 7) of device 10 is off and processing circuitry 36 (FIG. 7) is off. In this state, device 10 is fully off.

If the user presses a power-on button such as button 19 of FIG. 1, processing circuitry 36 can power up, while the RF transceiver 66 remains powered off, as indicated by state 252. In state 252, the user can use the features of handheld electronic device 10 that are not affected by the powered-down RF transceiver 66 (e.g., wired communications features, wireless communications using different antennas and transceivers in device 10, media playback features, etc.) Because RF transceiver 66 is in a sleep mode or is otherwise inactive and not fully powered, transceiver circuitry 66 and handheld electronic device 10 consume a reduced amount of power. If desired, power consumption can also be reduced in this way by selectively deactivating part of the functionality of RF transceiver 66 (e.g., by disabling transmitter circuitry in transceiver 66 while allowing receiver circuitry to function normally or in a reduced-power state).

If the user presses the power button again (or presses a power-off button), the handheld electronic device 10 may transition from state 252 to state 248.

If, however, the user presses antenna button 14 while in state 252 to place antenna button 14 in its out or deployed position, transceiver 66 and processing circuitry 36 may be powered (state 254). In state 254, handheld device 10 may be fully functional. For example, a user can use transceiver 66 and button antenna 14 to wirelessly send and receive data with external components such as accessories 46 and computing equipment 48, as described in connection with FIG. 4.

When the user presses button antenna 14 inwards while in state 254, antenna 14 may no longer be far enough away from the ground of case 12 to function optimally. The transceiver 66 may therefore be powered down to conserve power (state 252).

If desired, device 10 may be permitted to enter a fourth state 250 in which transceiver 66 is on while the processing circuitry 66 is off. The user may enter this state from state 248 by deploying button antenna 14 before pressing the power-on button or may enter this state from state 254 by pressing the power-off button while the transceiver 66 is on.

If desired, the user may transition directly from state 248 to state 254 when button antenna 14 is pressed, thereby obviating the need to press both the power button and button antenna 14. Other configurations (in which, for example, other buttons and functions of the handheld electronic device are involved) may be used if desired. The arrangement of FIG. 38 is merely illustrative.

The foregoing is merely illustrative of the principles of this invention and various modifications can be made by those skilled in the art without departing from the scope and spirit of the invention.

What is claimed is:

1. A handheld electronic device button antenna, comprising:

a movable button member;

a latching mechanism;

a resonating element disposed in the button member; and a ground, wherein the antenna is formed as part of a handheld electronic device that comprises transceiver circuitry coupled to the antenna and that comprises a conductive handheld electronic device case, wherein the ground is formed at least partly from the conductive handheld electronic device case, wherein the movable button member is movable between at least a first position in which the transceiver circuitry is in a first operating state and a second position in which the transceiver circuitry is in a second operating state that is different than the first state and wherein in the first position the movable button member is held in place with the latching mechanism.

2. The handheld electronic device button antenna defined in claim 1 wherein the resonating element comprises:

a planar substrate; and a conductive trace formed on the substrate.

3. The handheld electronic device button antenna defined in claim 1 wherein the latching mechanism comprises a push-push latching mechanism coupled to the button member.

4. The handheld electronic device button antenna defined in claim 1 wherein the button member comprises a rectangular button surface and portions defining a slot, wherein the resonating element is disposed within the slot and comprises a planar substrate and a conductive trace formed on the substrate.

5. The handheld electronic device button antenna defined in claim 1 wherein the button member comprises plastic, wherein the resonating element comprises a conductive trace, and wherein the ground is formed from a metal handheld electronic device case.

6. An electronic device comprising:

storage that stores data;

processing circuitry coupled to the storage that generates data for wireless transmission and that processes wirelessly received data;

wireless communications circuitry that communicates with the processing circuitry, wherein the wireless communications circuitry comprises a movable button antenna comprising a resonating element formed on a planar substrate; and a conductive housing that forms a ground for the button antenna and that has an outer surface, wherein the button antenna comprises:

a button member that has a top surface;

a resonating element disposed within the button member; and a latching mechanism that holds the button member in an undeployed button antenna position in which the top surface of the button member lies flush with the outer surface of the housing and a deployed button antenna position in which the top surface of the button member protrudes beyond the outer surface of the housing.

7. The electronic device defined in claim 6, wherein the top surface is pressed to move the button member.

8. The electronic device defined in claim 6, wherein the top surface is pressed to position the button member relative to the case.

9. An electronic device comprising:

storage that stores data;

processing circuitry coupled to the storage that generates data for wireless transmission and that processes wirelessly received data;

wireless communications circuitry that communicates with the processing circuitry, wherein the wireless communications circuitry comprises a movable button antenna comprising a resonating element formed on a planar substrate;

a conductive housing that forms a ground for the button antenna; and transceiver circuitry, wherein the button antenna comprises:

a button member that has a surface;

a resonating element disposed within the button member; and a latching mechanism that holds the button member in an undeployed button antenna position in which the transceiver circuitry is inactive and a deployed button antenna position in which the transceiver circuitry is active.

10. A handheld electronic device comprising:

a button antenna that is movable between a deployed position and an undeployed position;

processing circuitry that is used to operate the handheld electronic device;

radio-frequency transceiver circuitry coupled to the processing circuitry and to the button antenna that transmits and receives radio-frequency signals using the button antenna when the button antenna is in the deployed position;

a metal housing that forms a ground for the button antenna;

a sensor that detects when the button antenna is in the deployed position and that detects when the button antenna is in the undeployed position; and a latching mechanism that holds the button antenna in an undeployed button antenna position.

11. The handheld electronic device defined in claim 10 further comprising:

a display on a front surface of the handheld electronic device; and a user input interface on the front surface.

12. A handheld electronic device comprising:

a button antenna that is movable between a deployed position and an undeployed position;

processing circuitry that is used to operate the handheld electronic device;

radio-frequency transceiver circuitry coupled to the processing circuitry and to the button antenna that transmits and receives radio-frequency signals using the button antenna when the button antenna is in the deployed position;

a metal housing that forms a ground for the button antenna;

a sensor that detects when the button antenna is in the deployed position and that detects when the button antenna is in the undeployed position, wherein when the antenna is in the deployed position, the processing circuitry places the radio-frequency transceiver in an active state and when the antenna is in the undeployed position, the processing circuitry places the radio-frequency transceiver in an inactive state; and a latching mechanism that holds the button antenna in the undeployed position.

13. A handheld electronic device comprising:

a button antenna that is movable between a deployed position and an undeployed position;

processing circuitry that is used to operate the handheld electronic device;

radio-frequency transceiver circuitry coupled to the processing circuitry and to the button antenna that transmits and receives radio-frequency signals using the button antenna when the button antenna is in the deployed position;

a metal housing that forms a ground for the button antenna, wherein the button antenna comprises a button member; and a sensor that detects when the button antenna is in the deployed position and that detects when the button antenna is in the undeployed position, wherein when the antenna is in the deployed position, the processing circuitry places the radio-frequency transceiver in an active state and when the antenna is in the undeployed position, the processing circuitry places the radio-frequency transceiver in an inactive state, wherein the sensor comprises a switch that is attached to the button member; and a latching mechanism that holds the button antenna in the undeployed position.

14. A method for using a handheld electronic device having a movable button antenna, wherein the movable button antenna has a button member that contains a resonating element and wherein the handheld electronic device comprises a conductive case that forms a ground for the button antenna, the method comprising:

placing the movable button antenna in an in position in which the resonating element is substantially recessed within the conductive case and in which the movable button antenna is held in place with a latching mechanism; and placing the movable button antenna in an out position in which the resonating element substantially protrudes from the conductive case and transmits and receives radio-frequency wireless signals.

15. The method defined in claim 14 wherein placing the movable button antenna in the in position comprises placing the movable button antenna in an in position in which the resonating element does not transmit and does not receive radio-frequency wireless signals.

16. The method defined in claim 14 wherein the handheld electronic device comprises a sensor, the method further comprising:

sensing the position of the button member with the sensor.

17. The method defined in claim 14 wherein the handheld electronic device comprises a radio-frequency transceiver coupled to the button antenna, the method further comprising:

turning on the radio-frequency transceiver when the movable button antenna is in the out position; and turning off the radio-frequency transceiver when the movable button antenna is in the in position.

18. The method defined in claim 14 wherein the handheld electronic device comprises a sensor, the method further comprising:

sensing the position of the movable button antenna by sensing the position of the button member with the sensor;

turning on the radio-frequency transceiver when the sensor senses that the movable button antenna is in the out position; and turning off the radio-frequency transceiver when the sensor senses that the movable button antenna is in the in position.

19. The method defined in claim 14 wherein the handheld electronic device comprises a power on-off button that is separate from the button antenna, the method further comprising:

pressing the power on-off button to turn the handheld electronic device on, wherein placing the movable button antenna in the in position comprises turning off the transceiver while the handheld electronic device is on by pressing the button member into the case while the handheld electronic device is on.

20. A pushbutton antenna for an electronic device that has a conductive case with a conductive case surface, comprising:

a button member having a top surface;

a radiating element attached to the button member; and a pushbutton latching mechanism that holds the pushbutton antenna in a deployed position in which the radiating element protrudes outwardly beyond the conductive case surface and an undeployed position in which the radiating element is recessed beneath the conductive case surface.

21. The pushbutton antenna defined in claim 20 wherein the top surface of the button member and the conductive case surface comprise flat surfaces and wherein when the pushbutton antenna is in the undeployed position the top surface of the button member lies flush with the conductive case surface.

22. The pushbutton antenna defined in claim 20 wherein at least part of the conductive case forms a ground for the pushbutton antenna.

23. The pushbutton antenna defined in claim 20 further comprising a spring-loaded pin that is attached to the button member and that makes electrical contact with the conductive case when the pushbutton antenna is in the deployed position.

24. The pushbutton antenna defined in claim 20 further comprising a spring that is attached to the button member and that makes electrical contact with the conductive case when the pushbutton antenna is in the deployed position.

25. A handheld electronic device comprising:

a movable button antenna, wherein the movable button antenna has a button member that contains a resonating antenna element formed on a planar substrate;

a radio-frequency transceiver;

a flexible conductive path that conveys signals between the radio-frequency transceiver and the movable button antenna and that maintains an electrical connection between the resonating antenna element and the radio-frequency transceiver as the movable button antenna is moved from an in position to an out position;

a metal case, wherein the metal case forms a ground for the movable button antenna and wherein the flexible conductive path contains a ground conductor; and a latching mechanism that holds the movable button antenna in place when the movable button antenna is in the in position.

26. The handheld electronic device defined in claim 25 further comprising:

an electrical connecting structure that electrically connects the ground conductor in the flexible conductive path to the metal case when the movable button antenna is in the out position.

27. The handheld electronic device defined in claim 25 further comprising:

a spring-loaded pin that electrically connects the ground conductor in the flexible conductive path to the metal case when the movable button antenna is in the out position.

28. The handheld electronic device defined in claim 25 wherein the flexible conductive path comprises a coaxial cable, the handheld electronic device further comprising:

an electrical connecting structure that is attached to the button member and that electrically connects the ground conductor in the coaxial cable to the metal case when the movable button antenna is in the out position.

29. The handheld electronic device defined in claim 25 wherein the flexible conductive path has a bend, wherein the button member has a top surface, and wherein the resonating element has at least one conductor that lies parallel to the top surface, the handheld electronic device further comprising:

a spring-loaded pin that is attached to the button member and that electrically connects the ground conductor in the flexible conductive path to the metal case when the movable button antenna is in the out position; and a button trim attached to the metal case that guides the button member as the movable button antenna moves between the in position and the out position.

* * * * *

UNITED STATES PATENT AND TRADEMARK OFFICE

CERTIFICATE OF CORRECTION

PATENT NO. : 7,639,187 B2
APPLICATION NO. : 11/527192
DATED : December 29, 2009
INVENTOR(S) : Caballero et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 236 days.

Signed and Sealed this

Ninth Day of November, 2010

David J. Kappos

David J. Kappos
*Director of the United States Patent and Trademark Office*